US009543670B2

(12) United States Patent
Montena

(10) Patent No.: US 9,543,670 B2
(45) **Date of Patent: *Jan. 10, 2017**

(54) MULTI-CONDUCTOR CABLE CONNECTOR FOR MULTIPLE COAXIAL CABLES

(71) Applicant: PPC Broadband, Inc., East Syracuse, NY (US)

(72) Inventor: Noah P. Montena, Syracuse, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/570,487

(22) Filed: Dec. 15, 2014

(65) Prior Publication Data

US 2015/0099395 A1 Apr. 9, 2015

Related U.S. Application Data

(63) Continuation of application No. 13/152,431, filed on Jun. 3, 2011, now Pat. No. 8,911,254.

(51) Int. Cl.
*H01R 9/05* (2006.01)
*H01R 9/03* (2006.01)
*H01R 43/20* (2006.01)

(52) U.S. Cl.
CPC ..... *H01R 9/0503* (2013.01); *H01R 9/032* (2013.01); *H01R 9/05* (2013.01); *H01R 43/20* (2013.01); *Y10T 29/49204* (2015.01)

(58) Field of Classification Search
CPC ..... H01R 9/0506
USPC ..... 439/579, 578
See application file for complete search history.

(56) References Cited

U.S. PATENT DOCUMENTS

| | | | | |
|---|---|---|---|---|
| 2,238,834 | A | 4/1941 | Travers | |
| 2,449,983 | A | 9/1948 | Devol | |
| 2,761,110 | A | 8/1956 | Edlen et al. | |
| 3,184,706 | A | 5/1965 | Atkins | |
| 3,336,563 | A | 8/1967 | Hyslop | |
| 3,509,513 | A * | 4/1970 | Russin | 439/468 |
| 3,683,320 | A | 8/1972 | Woods et al. | |
| 3,706,958 | A | 12/1972 | Blanchenot | |
| 3,848,164 | A * | 11/1974 | Otte | 439/579 |
| 3,852,700 | A | 12/1974 | Haws | |
| 4,261,632 | A | 4/1981 | Narozny | |

(Continued)

FOREIGN PATENT DOCUMENTS

DE 4229812 C1 3/1994

OTHER PUBLICATIONS

U.S. Appl. No. 12/955,978, filed Nov. 30, 2010.

*Primary Examiner* — Neil Abrams
(74) *Attorney, Agent, or Firm* — Barclay Damon, LLP

(57) ABSTRACT

A multi-conductor cable connector for coaxial cables is provided, the connector including a cable connection portion, wherein the cable connection portion receives a prepared multi-conductor cable having a plurality of conductive strands concentrically sharing a common central axis, and a multi-contact portion coupled to the cable connection portion, the multi-contact portion having a plurality of contacts non-concentrically aligned with the cable connection portion. A fastener member may be used to receive portions of two prepared cables and a hollow clamping member. The fastener member compresses the hollow clamping member onto a portion of each of the two prepared cables.

26 Claims, 14 Drawing Sheets

(56) References Cited

U.S. PATENT DOCUMENTS 4,352,240 A 10/1982 Komada
4,374,458 A 2/1983 Komada
4,553,806 A 11/1985 Forney, Jr. et al.
4,557,546 A 12/1985 Dreyer
4,572,600 A 2/1986 Nieman
4,605,269 A 8/1986 Cohen et al.
4,615,578 A * 10/1986 Stadler ..... H01R 12/775 439/607.47
4,688,877 A 8/1987 Dreyer
4,689,440 A 8/1987 Morin
4,789,355 A 12/1988 Lee
4,799,902 A 1/1989 Laudig et al.
4,813,888 A * 3/1989 Tokizane ..... H01R 24/525 439/578
4,941,831 A 7/1990 Tengler et al.
4,964,814 A * 10/1990 Tengler et al. ..... 439/607.56
4,974,075 A 11/1990 Nakaiima
5,046,966 A * 9/1991 Snyder et al. ..... 439/579
5,066,248 A 11/1991 Gayer, Jr. et al.
5,073,129 A 12/1991 Szegda
5,154,637 A 10/1992 Klug et al.
5,176,538 A * 1/1993 Hansell, III ..... H01R 13/65802 439/607.23
5,184,965 A 2/1993 Myschik et al.
5,190,473 A * 3/1993 Mroczkowski .... H01R 13/6593 439/580
5,241,135 A * 8/1993 Fetzer ..... 174/88 R
5,261,839 A 11/1993 Franks, Jr.
5,318,458 A 6/1994 Thorner
5,362,251 A 11/1994 Bielak
5,441,424 A * 8/1995 Morlion et al. ..... 439/581
5,470,257 A 11/1995 Szegda
5,527,190 A 6/1996 Weingartner
5,823,825 A * 10/1998 Murphy ..... H01R 9/038 439/607.5
5,890,925 A 4/1999 Bernardini
5,906,511 A * 5/1999 Bozzer et al. ..... 439/579
5,964,620 A * 10/1999 Takahashi ..... H01R 9/0518 439/579
5,967,855 A * 10/1999 Asakura et al. ..... 439/681
5,980,308 A * 11/1999 Hu ..... H01R 12/598 439/497
5,997,350 A * 12/1999 Burris ..... H01R 9/0521 285/249
6,109,963 A 8/2000 Follingstad et al.
6,116,945 A 9/2000 Davis et al.
6,123,567 A 9/2000 McCarthy
6,149,469 A 11/2000 Kim
6,153,830 A 11/2000 Montena
6,179,656 B1 1/2001 Wong
6,210,222 B1 4/2001 Langham et al.
6,254,430 B1 7/2001 Endo et al.
6,261,126 B1 7/2001 Stirling
6,331,123 B1 12/2001 Rodrigues
6,336,826 B1 * 1/2002 Kraft ..... H01R 13/6463 439/498
6,354,879 B1 * 3/2002 Plehaty ..... H01R 9/032 439/607.41
6,364,701 B1 * 4/2002 O'Sullivan et al. ..... 439/579
6,489,563 B1 * 12/2002 Zhao ..... H01R 9/0524 174/88 C
6,517,379 B2 2/2003 Leve
6,524,135 B1 * 2/2003 Feldman ..... H01R 9/035 439/607.46
6,558,194 B2 5/2003 Montena
6,568,964 B2 5/2003 D'Addario
6,575,784 B1 6/2003 Yamada
6,644,993 B2 11/2003 Victor
6,645,001 B2 * 11/2003 Okano ..... H01R 12/592 439/492
6,652,296 B2 * 11/2003 Kuroda ..... H01R 4/185 439/607.28
6,672,909 B2 * 1/2004 Dewdney ..... H01R 9/032 439/579
6,676,446 B2 1/2004 Montena
6,705,884 B1 3/2004 McCarthy
6,722,902 B2 4/2004 Kedzierski
6,729,912 B2 5/2004 D'Addario
6,749,454 B2 6/2004 Schmidt et al.
6,764,350 B2 7/2004 Kosmala
6,786,774 B2 9/2004 Haas, II et al.
6,848,940 B2 2/2005 Montena
6,857,899 B2 * 2/2005 Reed ..... H01R 23/662 439/497
6,860,760 B2 3/2005 Endo et al.
6,884,113 B1 4/2005 Montena
6,939,174 B2 * 9/2005 Wu ..... H01R 13/514 439/607.05
6,945,817 B2 * 9/2005 Miyazaki et al. ..... 439/579
6,966,796 B2 11/2005 Abe et al.
7,029,326 B2 4/2006 Montena
7,048,579 B2 5/2006 Montena
7,094,103 B2 8/2006 Lai
7,121,872 B1 10/2006 Hanks
7,153,159 B2 12/2006 Burris et al.
7,156,695 B2 1/2007 Holliday
D542,225 S 5/2007 Victor
7,217,155 B2 5/2007 Montena
7,226,320 B2 6/2007 Abe et al.
7,311,554 B1 12/2007 Jackson et al.
7,458,849 B2 12/2008 Rodriques et al.
7,458,851 B2 12/2008 Montena
7,476,119 B2 1/2009 D'Addario et al.
7,488,187 B2 2/2009 Wolf
7,670,154 B2 * 3/2010 Yu et al. ..... 439/98
7,819,675 B2 * 10/2010 Ko ..... H01R 9/034 439/98
7,841,898 B1 11/2010 Titus
7,857,643 B2 12/2010 Dobler
7,997,929 B2 8/2011 Montena
8,011,950 B2 * 9/2011 McGrath ..... H01R 12/594 439/497
8,016,615 B2 9/2011 Montena
8,123,556 B2 * 2/2012 Esplin et al. ..... 439/579
8,465,321 B2 * 6/2013 Montena ..... H01R 9/0524 439/579
8,771,012 B2 * 7/2014 Le Tortorec ..... H01R 13/2421 439/584
8,911,254 B2 * 12/2014 Montena ..... 439/579
9,105,375 B2 * 8/2015 Sugiyama ..... H01B 13/00
9,276,330 B2 * 3/2016 Wu ..... H01R 12/775
2003/0207620 A1 11/2003 Haas, II et al.
2003/0224658 A1 12/2003 Koch et al.
2005/0085125 A1 4/2005 Montena
2005/0164553 A1 7/2005 Montena
2006/0014425 A1 1/2006 Montena
2006/0063426 A1 3/2006 Khemakhem et al.
2006/0194474 A1 8/2006 Montena
2008/0045082 A1 2/2008 Kuo
2008/0261445 A1 10/2008 Malloy et al.
2009/0186503 A1 7/2009 Dobler
2009/0233482 A1 9/2009 Chawgo et al.
2010/0144183 A1 6/2010 Nania et al.
2010/0203760 A1 8/2010 Montena
2010/0261381 A1 10/2010 Montena et al.
2011/0039449 A1 2/2011 Montena
2011/0059648 A1 3/2011 Montena
2011/0059649 A1 3/2011 Montena
2011/0237110 A1 9/2011 Montena
2011/0300747 A1 12/2011 Montena
2011/0306226 A1 12/2011 Montena
2011/0306247 A1 12/2011 Montena
2012/0003870 A1 1/2012 Montena
2012/0094521 A1 4/2012 Montena
2012/0135629 A1 5/2012 Montena
2012/0309227 A1 12/2012 Montena
2013/0072058 A1 3/2013 Le Tortorec et al.
2015/0380840 A1 * 12/2015 Chiang ..... H01R 9/0506 439/579

* cited by examiner

MULTI-CONDUCTOR CABLE CONNECTOR FOR MULTIPLE COAXIAL CABLES

CROSS-REFERENCE TO RELATED APPLICATION

This application is a continuation of, and claims the benefit and priority of, U.S. patent application Ser. No. 13/152,431, filed on Jun. 3, 2011. The entire contents of foregoing application are hereby incorporated by reference.

FIELD OF TECHNOLOGY

The present invention relates generally to multi-conductor communications, and more specifically to embodiments of a multi-conductor cable connector having more than one coaxial cable.

BACKGROUND

Traditional connectors for balanced audio cables, DMX lighting cables, mains power cables, and speaker cables have terminals/contacts which are non-coaxial and typically are connected to wire by soldering, set screw, or clamp. Often, multi-conductor cables have a pair of twisted wires surrounded by a braided shield. Common multi-conductor cable connectors utilize multiple electrically isolated terminals/contacts corresponding to the multiple conductive strands of the multi-conductor cable. Typically, each of the conductive strands of a multi-conductor cable is soldered to respective terminals/contacts of a corresponding common multi-conductor cable connector. Using a multi-conductor cable, such as a triaxial cable and a specially formed connector to effect proper alignment can avoid the hassles and problems associated with soldering; however, multi-conductor cables are somewhat inflexible and require the use of nonstandard trimming tools which adds to the difficulty in preparing the multi-conductor cable, and adds to the complexity of the specially formed connectors.

Thus, a need exists for an apparatus and method for efficiently ensuring proper connection of the multiple conductive strands while maintaining the benefits of a coaxial cable, such as ease of preparation and RF shielding properties.

SUMMARY

A first general aspect relates to a multi-conductor cable connector comprising a cable connection portion, wherein the cable connection portion receives at least two prepared coaxial cables each having a plurality of conductive strands concentrically sharing a common central axis; and a multi-contact portion coupled to the cable connection portion, the multi-contact portion having a plurality of contacts non-concentrically aligned with the cable connection portion.

A second general aspect relates to a multi-conductor cable connector comprising a first post configured to receive a first prepared coaxial cable; a second post configured to receive a second prepared coaxial cable; a clamping element configured to seize the received first and second prepared coaxial cables; and a connector body disposed over the first post and the second post, wherein the connector body is in electrical communication with at least one conductive strand layer of the first and the second prepared coaxial cable to extend a shield through the connector; wherein the connector body surrounds a plurality of non-concentrically aligned electrical contacts.

A third general aspect relates to a multi-conductor cable connector device comprising: a first post, configured for receiving a portion of a first prepared coaxial cable, the first prepared coaxial cable having a center conductive strand and a conductive strand layer concentrically sharing a common central axis; a second post, configured for receiving a portion of a second prepared coaxial cable, the second prepared coaxial cable having a center conductive strand and a conductive strand layer concentrically sharing a common central axis; a clamping element configured to seize the first and second prepared coaxial cables; a connector body disposed over the first post and the second post; and a conductive member disposed within the connector body, the conductive member having a first opening for receiving a first electrical contact, a second opening for receiving a second electrical contact, and a third opening for receiving a third electrical contact; wherein the second electrical contact electrically communicates with the center conductive strand of the first coaxial cable to extend a first continuous electrical path through the connector, and the third electrical contact electrically communicates with the center conductive strand of the second coaxial cable to extend a second continuous electrical path through the connector.

A fourth general aspect relates to a multi-conductor cable connector comprising: a cable connection portion, wherein the cable connection portion receives at least two prepared coaxial cables having a plurality of conductive strands concentrically sharing a common central axis; a plurality of non-concentrically aligned electrical contacts; and means for coupling the plurality of non-concentrically aligned contacts to the cable connection portion to extend more than one continuous electrical path through the connector. A fifth general aspect relates to a method of forming a multi-conductor cable connection, the method comprising providing a multi-conductor cable connector, the multi-conductor cable connector including: a cable connection portion, wherein the cable connection portion receives at least two prepared coaxial cable having a plurality of conductive strands concentrically sharing a common central axis; and a multi-contact portion coupled to the cable connection portion, the multi-contact portion having a plurality of contacts non-concentrically aligned with the cable connection portion; and mating the multi-conductor cable connector with a separate device having a corresponding plurality of mating electrical contacts to complete the electrical connection.

Another general aspect relates to a multi-conductor cable connector comprising a cable connection portion, wherein the cable connection portion receives at least two prepared coaxial cables; and a multi-contact portion coupled to the cable connection portion, the multi-contact portion having a plurality of contacts that extend on different axes, wherein at least one of the plurality of contacts is configured to establish an electrical ground path through the multi-contact portion, the electrical ground path extending through each of the at least two prepared coaxial cables; and wherein the multi-contact portion is configured to extend an electrical path from the at least two prepared coaxial cables.

Another general aspect relates to a multi-conductor cable connector comprising a first post configured to receive a portion of a first prepared coaxial cable; a second post configured to receive a portion of a second prepared coaxial cable; a clamping element configured to seize the received first and second prepared coaxial cables; and a connector body disposed over the first post and the second post, wherein the connector body is in electrical communication with at least one conductive strand layer of the first and the second prepared coaxial cable to extend a shield through the connector; wherein the connector body surrounds a plurality of electrical contacts which extend on different axes; wherein at least one of the plurality of contacts is configured to establish an electrical ground path through the multi-contact portion, the electrical ground path extending through each of the two prepared coaxial cables; and wherein the multi-contact portion is configured to extend an electrical path from the two prepared coaxial cables.

Another general aspect relates to a multi-conductor cable connector device comprising: a first post, configured for receiving a portion of a first prepared coaxial cable, the first prepared coaxial cable having a center conductive strand and a conductive strand layer concentrically sharing a common central axis; a second post, configured for receiving a portion of a second prepared coaxial cable, the second prepared coaxial cable having a center conductive strand and a conductive strand layer concentrically sharing a common central axis; a clamping element configured to seize the first and second prepared coaxial cables; a connector body surrounding the first post and the second post; and a conductive member located within the connector body, the conductive member configured to receive a plurality of electrical contacts; wherein at least one of the plurality of contacts is configured to establish an electrical ground path through the multi-contact portion, the electrical ground path extending through each of the two prepared coaxial cables; and wherein the multi-contact portion is configured to extend an electrical path from the two prepared coaxial cables.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Figure 1A:
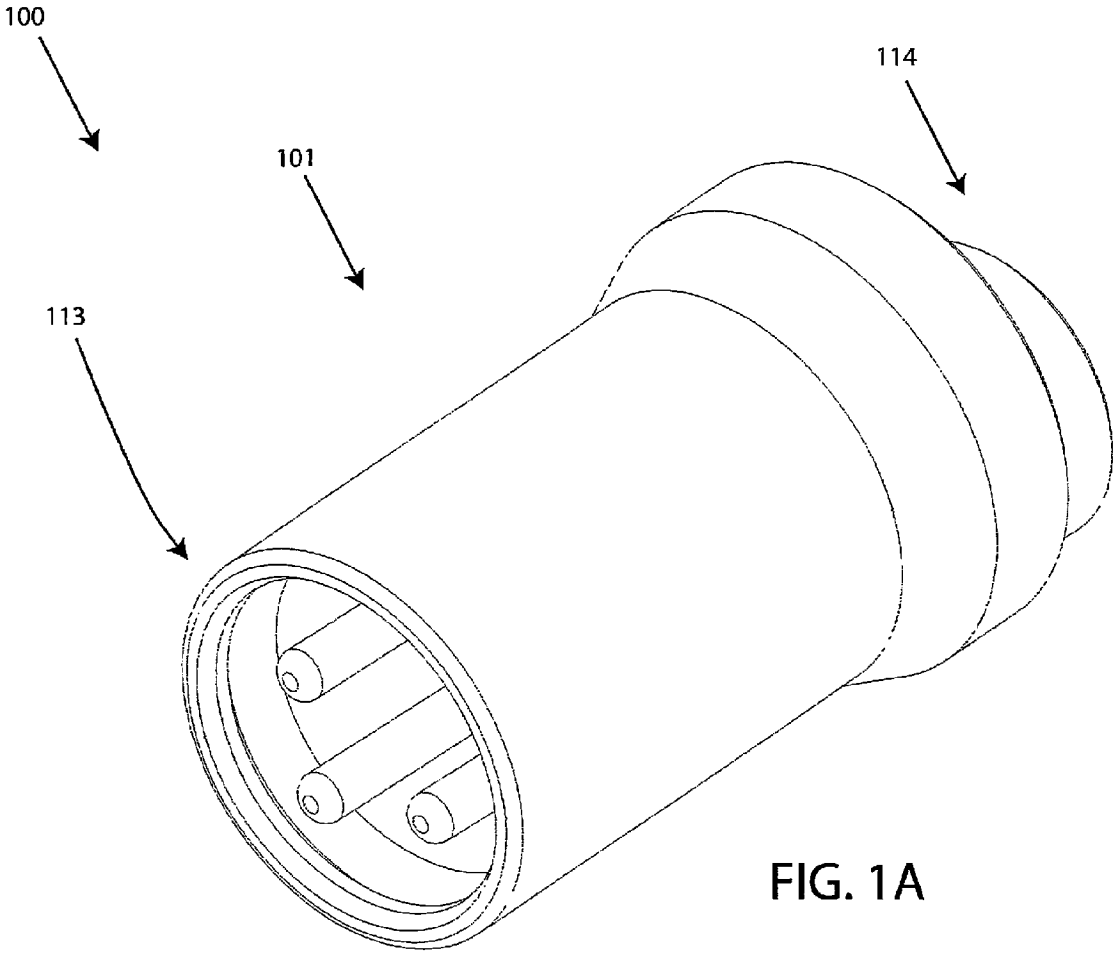
FIG. 1A depicts a perspective view of a first embodiment of a multi-conductor cable connector.
Figure 1B:
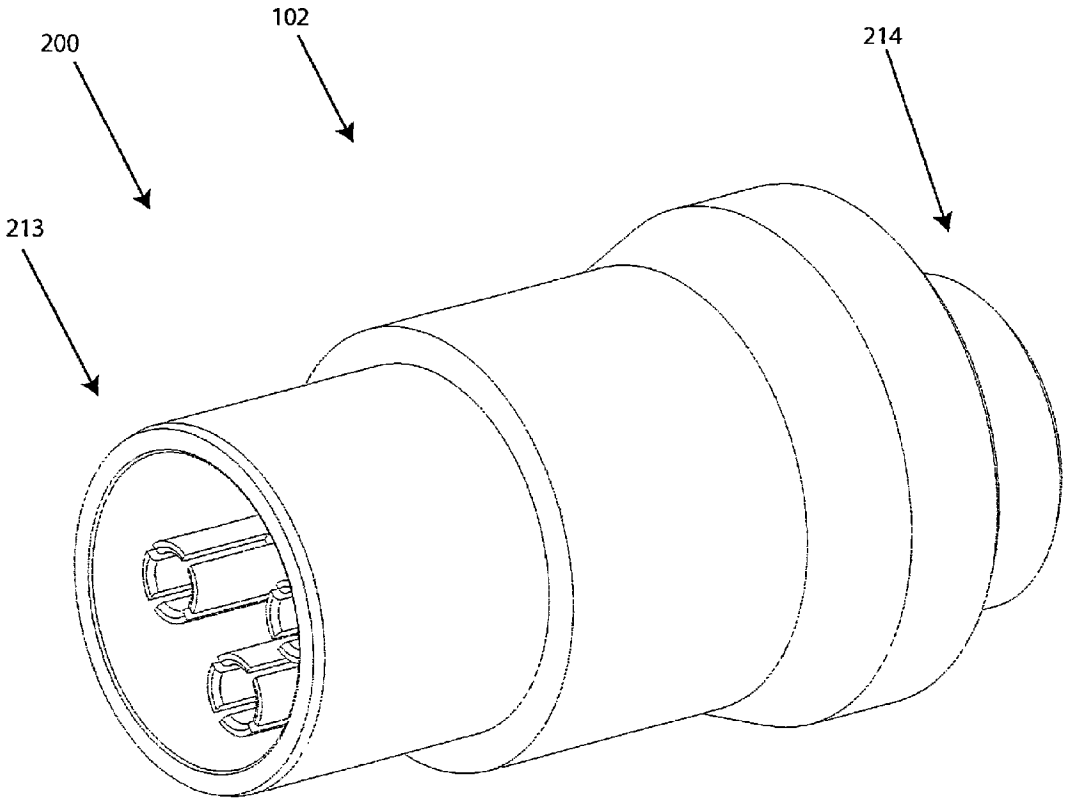
FIG. 1B depicts a perspective view of a second embodiment of a multi-conductor cable connector.

Referring to the drawings, FIG. IA depicts an embodiment of a multi-conductor cable 100 including embodiments of a multi-contact portion 113 and a cable connection portion 114. The multi-conductor cable connector embodiment 100 may be a male connector 101 FIG. 1B depicts an embodiment of a multi-conductor cable 200 having embodiments of a multi-contact portion 213 and a cable connection portion 214. The multi-conductor cable connector embodiment 200 may be a female connector 102. As depicted in FIG. 1A, connector 100 may include a multi-contact portion 113 coupled to the cable connection portion 114. In one embodiment of a multi-conductor cable connector 100, the multi-contact portion 113 may be coupled to the cable connection portion 114 in coaxial union (e.g. connected at an angle of 0° or 180°) with the cable connection portion 114. In another embodiment, the multi-contact portion 113 may be coupled to the cable connection portion 114 by the use of an additional structural element. In still another embodiment, the multi-contact portion 113 may be partially coupled coaxially to the cable connection portion 114. In still yet another embodiment, the multi-contact portion 113 may be connected to the cable connection portion 114 at an angle other than 0° or 180°.

A multi-conductor cable connector embodiment 100 has a first end 1 and a second end 2, and can be provided to a user in a preassembled configuration to ease handling and installation during use. Multi-conductor cable connector 100 may be a XLR connector, XLR3 connector, any XLR-type connector, 3-contact connector, and the like. Embodiments of the connector 100 may have a cable connection portion 114. Embodiments of multi-conductor cable connector 100, 200, 300 may include a cable connection portion 114, 214, 314 wherein the cable connection portion 114, 214, 314 receives at least two prepared coaxial cables 10*a*, 10*b* each having a plurality of conductive strands 14*a*, 14*b* concentrically sharing a common central axis, and a multi-contact portion 113,

213, 313 coupled to the cable connection portion 114, 214, 314 the multi-contact portion 113, 213, 313 having a plurality of contacts 110, 120, 130, 210, 220, 230, 310, 320 non-concentrically aligned with the cable connection portion 114, 214, 314. The means for coupling the plurality of non-concentrically aligned contacts 110, 120, 130, 210, 220, 230, 310, 320 to the cable connection portion 114, 214, 314 to extend more than one continuous electrical path through the connector 100, 200, 300 may include various embodiments disclosed herein, including the cable connection portion 114, 214, 314 coupled to a multi-contact portion 113, 213, 313, configured to receive at least two coaxial cables 10*a*, 10*b*.

Figure 2:
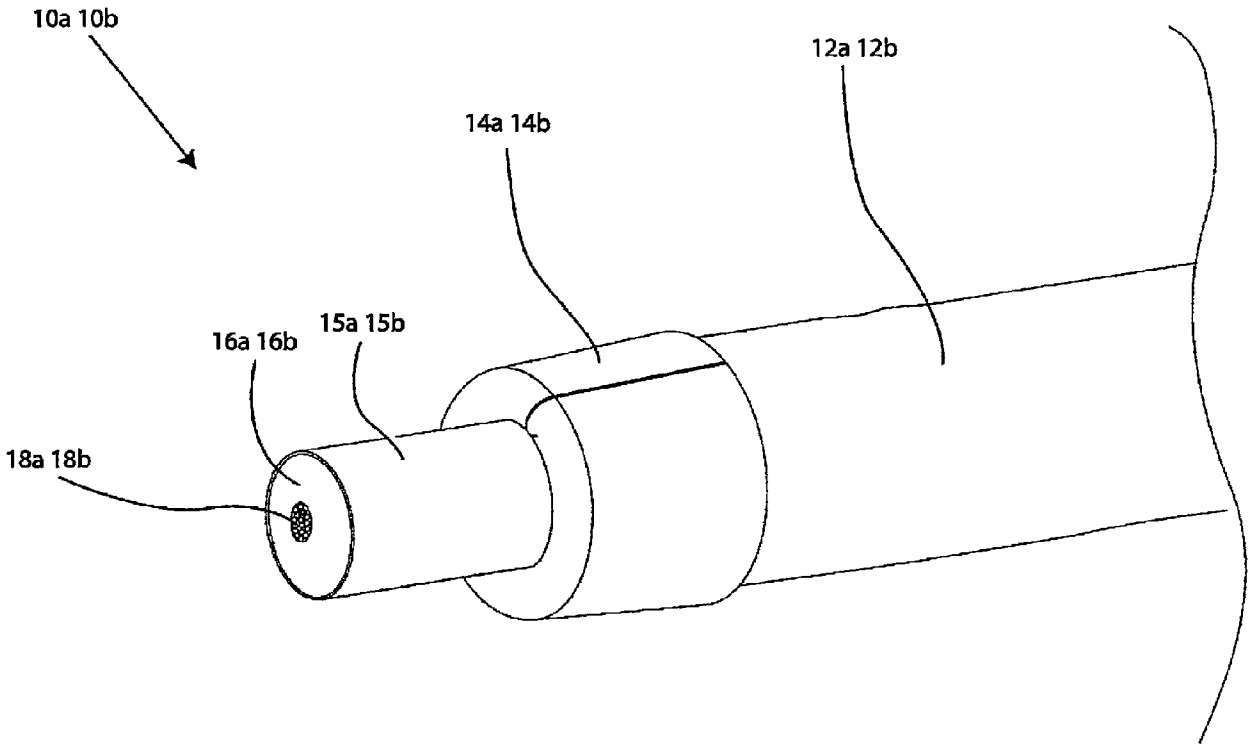
FIG. 2 depicts a perspective view of a first embodiment of a coaxial cable having a plurality of conductive strands concentrically sharing a common central axis.

Referring now to FIG. 2, the cable connection portion 114 of a multi-conductor cable connector 100 may be operably affixed to a prepared end of at least two coaxial cables 10*a*, 10*b* so that the coaxial cables 10*a*, 10*b* are securely attached to the cable connection portion 114. Coaxial cables 10*a*, 10*b* may be the same or substantially the same type of coaxial cable design; however, embodiments of coaxial cables 10*a*, 10*b* may be of different coaxial cable designs (e.g. different sizes, etc). The coaxial cables 10*a*, 10*b* may each include a center conductive strand 18*a*, 18*b*, surrounded by an interior dielectric 16*a*, 16*b*; the interior dielectric 16*a*, 16*b* may possibly be surrounded by a conductive foil layer 15*a*, 15*b*; the interior dielectric 16*a*, 16*b* (and the possible conductive foil layer 15*a*, 15*b*) is surrounded by a conductive strand layer 14*a*, 14*b*; the first conductive strand layer 14*a*, 14*b* is surrounded by a protective outer jacket 12*a*, 12*b*, wherein the protective outer jacket 12*a*, 12*b* has dielectric properties and serves as an insulator. The conductive strand layer 14*a*, 14*b* may be the radially outermost conductive strand layer of the cables 10*a*, 10*b*. For instance, the conductive strand layer 14*a*, 14*b* may extend a grounding/shielding path providing an electromagnetic shield about the center conductive strand 18*a*, 18*b* of the first and second coaxial cables 10*a*, 10*b*. The multiple prepared coaxial cables 10*a*, 10*b* may be prepared by removing the protective outer jacket 12*a*, 12*b* and drawing back the conductive strand layer 14*a*, 14*b* to expose a portion of the interior dielectric 16*a*, 16*b* (and possibly the conductive foil layer 15*a*, 15*b* that may tightly surround the interior dielectric 16*a*, 16*b*) and center conductive strand 18*a*, 18*b*. The protective outer jackets 12*a*, 12*b* can physically protect the various components of the coaxial cables 10*a*, 10*b* from damage which may result from exposure to dirt or moisture, and from corrosion. Moreover, the protective outer jackets 12*a*, 12*b* may serve in some measure to secure the various components of the coaxial cables 10*a*, 10*b* in a contained cable design that protects the cables 10*a*, 10*b* from damage related to movement during cable installation. The conductive strand layers 14*a*, 14*b* can be comprised of conductive materials suitable for carrying electromagnetic signals and/or providing an electrical ground connection or electrical path connection. The conductive strand layers 14*a*, 14*b* may also be conductive layers, braided layers, and the like. Various embodiments of the conductive strand layers 14*a*, 14*b* may be employed to screen unwanted noise. For instance, the first conductive strand layer 14*a* may comprise a metal foil (in addition to the possible conductive foil) wrapped around the dielectric 16*a*, 16*b* and/or several conductive strands formed in a continuous braid around the dielectric 16*a*, 16*b*. Combinations of foil and/or braided strands may be utilized wherein the conductive strand layers 14*a*, 14*b* may comprise a foil layer, then a braided layer, and then a foil layer. Those in the art will appreciate that various layer combinations may be implemented in order for the conductive strand layers 14*a*, 14*b* to effectuate an electromagnetic buffer helping to prevent ingress of environmental noise or unwanted noise that may disrupt broadband communications. The dielectric 16*a*, 16*b* may be comprised of materials suitable for electrical insulation. The protective outer jacket 12*a*, 12*b* may also be comprised of materials suitable for electrical insulation. It should be noted that the various materials of which all the various components of the coaxial cables 10*a*, 10*b* should have some degree of elasticity allowing the cables 10*a*, 10*b* to flex or bend in accordance with traditional broadband communications standards, installation methods and/or equipment. It should further be recognized that the radial thickness of each of the coaxial cables 10*a*, 10*b*, protective outer jackets 12*a*, 12*b*, conductive strand layers 14*a*, 14*b*, possible conductive foil layer 15*a*, 15*b*, interior dielectric 16*a*, 16*b* and/or center conductive strand 18*a*, 18*b* may vary based upon generally recognized parameters corresponding to broadband communication standards and/or equipment.

Referring now to FIGS. 3A-6B, embodiments of a cable connection portion 114 of multi-conductor cable 100 may include a first post 40*a* configured to receive a first coaxial cable 10*a*, a second post 40*b* configured to receive a second coaxial cable 10*b*, a clamping element 70, a first insulator 50*a*, a second insulator 50*b*, and a fastener member 60. Embodiments of a multi-conductor cable connector, such as embodiments 100, 200, may be fashioned so as to be either male or female. In other words, functional integrity and structural similarity of multi-contact connectability of the embodiments may be maintained, even if multi-conductor cable connector 100 was fashioned to be a female connector and multi-conductor cable connector 200 was fashioned to be a male connector. In particular, the cable connection portion 114, 214 of connector embodiments 100, 200 may share similar or substantially the same structural and/or functional aspects. Accordingly, embodiments of a cable connection portion 214 of multi-conductor cable connector 200 may include a first post 40*a* configured to receive a first coaxial cable 10*a*, a second post 40*b* configured to receive a second coaxial cable 10*b*, a clamping element 70, a first insulator 50*a*, a second insulator 50*b*, and a fastener member 60.

An embodiment of a cable connection portion 114 of connector 100 may include a first post 40 configured to receive a prepared portion of the first coaxial cable 10*a* (or one of the at least two coaxial cables), and a second post 40 configured to receive a prepared portion of the second coaxial cable 10*b* (or one of the at least two coaxial cables). The first post 40*a* and the second post 40*b* may share the same structural and functional aspects; thus, the first and second post 40*a*, 40*b* is described as a singular component. However, those skilled in the requisite art should appreciate that connector 100, 200 may include two or more posts for receiving two or more coaxial cables. The post 40*a*, 40*b* may include a first end 41*a*, 41*b* and an opposing second end 42*a*, 42*b*. Furthermore, the post 40*a*, 40*b* may include a thicker portion 45*a*, 45*b* proximate or otherwise near the first end 41*a*, 41*b*, where the thickness of the post 40*a*, 40*b* is greater than other sections of the post 40*a*, 40*b*. The thicker portion 45*a*, 45*b* has a first edge 43*a* and a second edge 44*a*, 44*b*. The first and second edges 43*a*, 43*b*, 44*a*, 44*b* may be perpendicularly aligned with the outer surface 46*a*, 46*b* of the post 40*a*, 40*b*, or may have any alignment or orientation that could provide a mating edge and/or surface for another component of the multi-conductor cable connector 100, 200. For example, the first and second edges 43*a*, 43*b*, 44*a*, 44*b* may form a right angle with the surface 46*a*, 46*b* of the post 40*a*, 40*b*, or be a tapered surface to accommodate different shaped components. The first edge 43*a*, 43*b* may be configured to make physical contact with a corresponding mating surface 56*a*, 56*b* of the first and second insulators 50*a*, 50*b*, respectively. For instance, the mating edge surface, such as first edge 43*a*, 43*b* of thicker portion 45*a*, 45*b* of the post 40*a*, 40*b* may abut, contact, communicate, border, touch, press against, and/or adjacently join with a mating surface, such as mating edge 56*a*, 56*b*, of the respective insulators 50*a*, 50*b*. Furthermore, the thicker portion 45*a*, 45*b* of the post 40*a*, 40*b* may be a raised portion, an annular extension, an oversized barrel portion, and the like, or may be a separate annular tubular member that tightly surrounds or generally substantially surrounds a portion of the post 40*a*, 40*b*, increasing the thickness of the post 40*a*, 40*b* for that particular section.

Figure 5A:
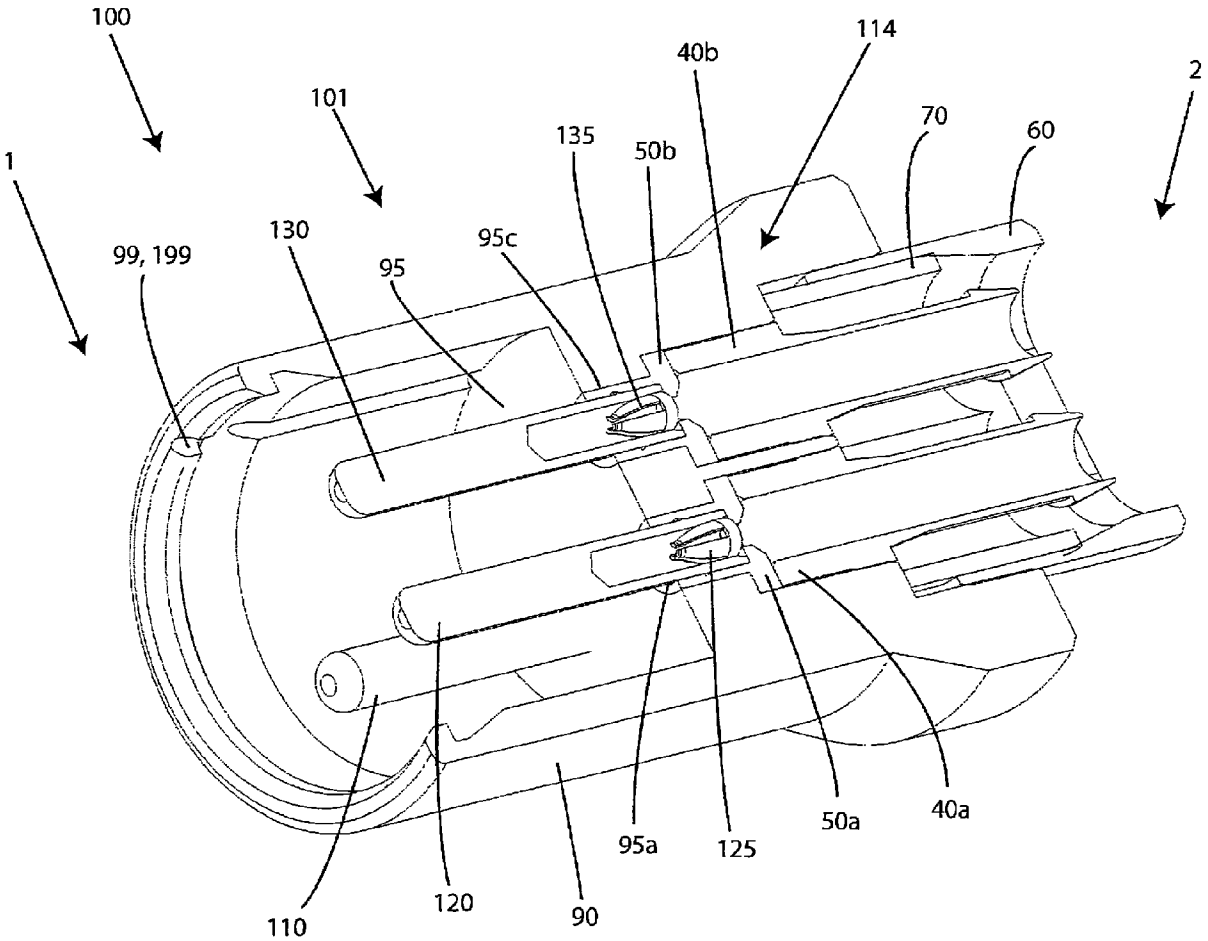
FIG. 5A depicts a perspective cut-away view of the first embodiment of the multi-conductor cable connector.
Figure 5B:
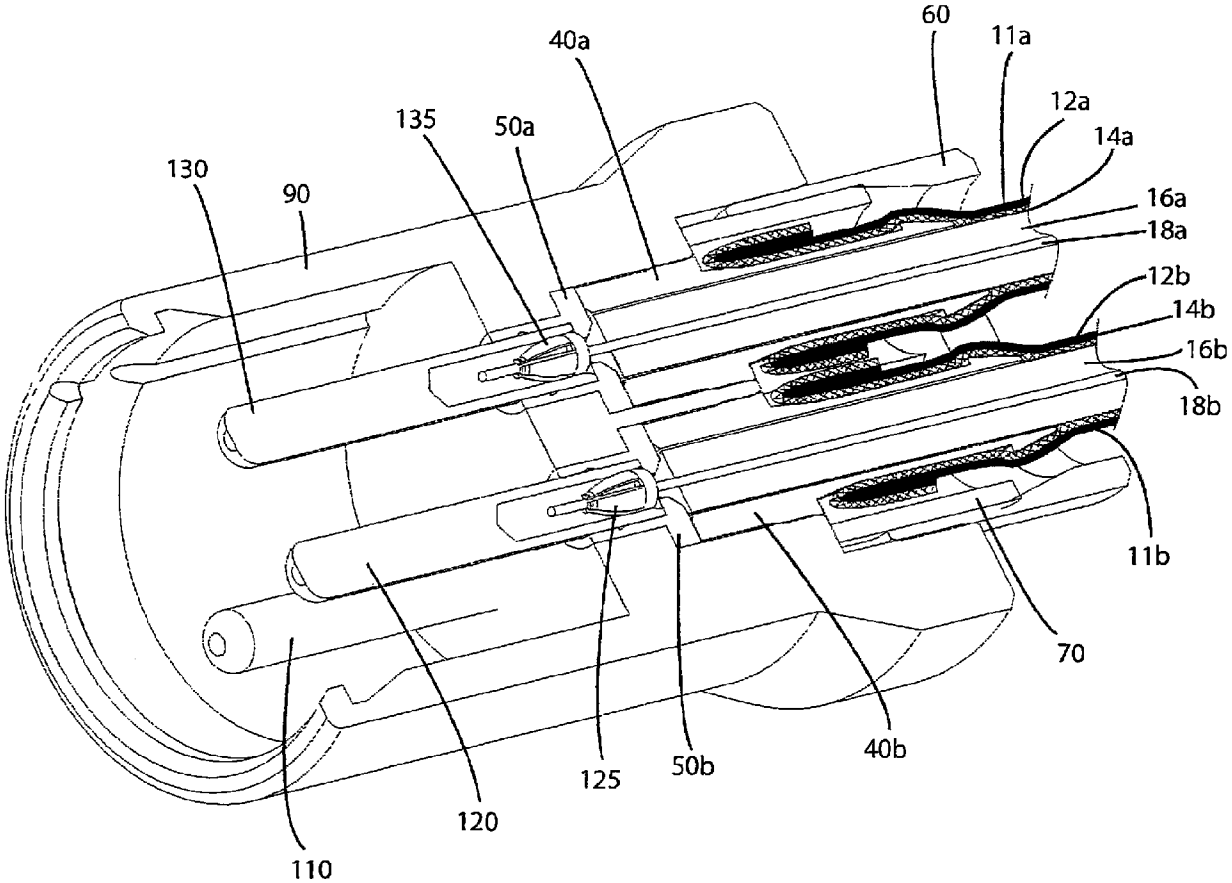
FIG. 5B depicts a perspective cut-away view of the first embodiment of the multi-conductor cable connector attached to at least two coaxial cables.
Figure 6A:
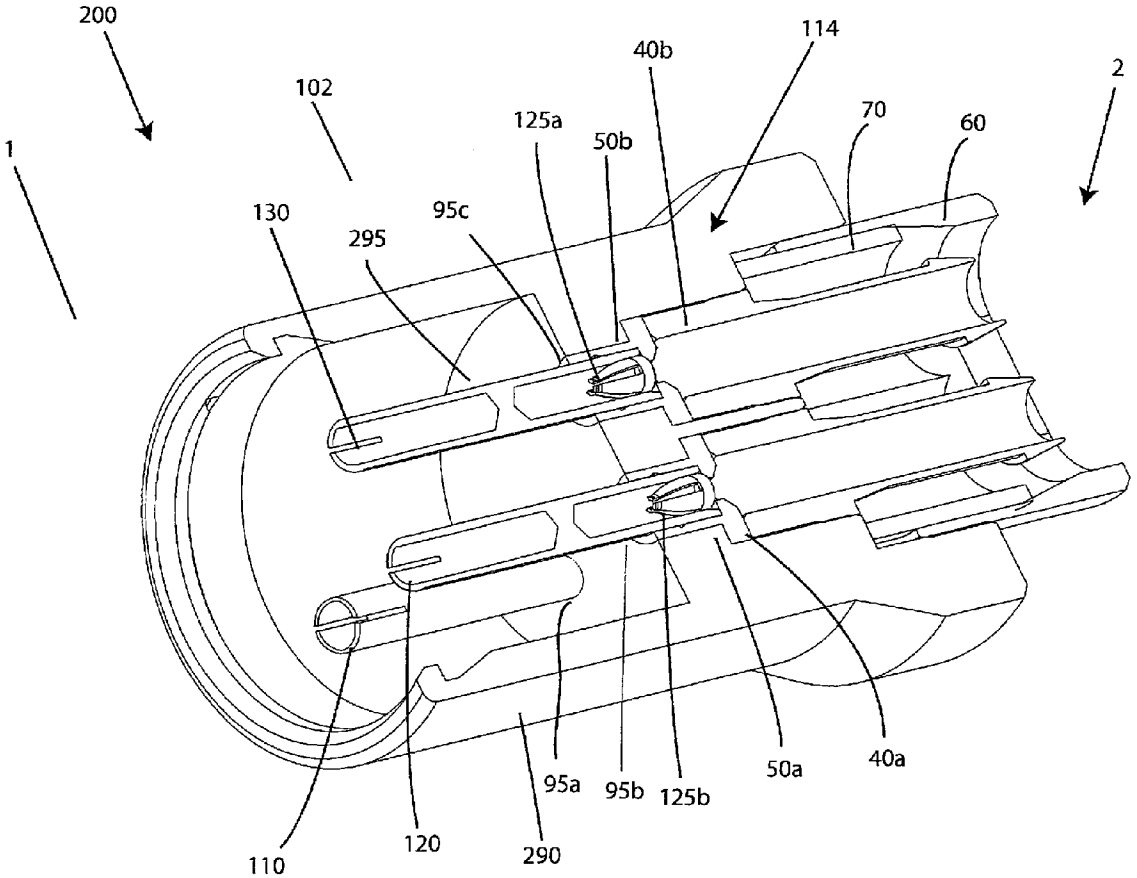
FIG. 6A depicts a perspective cut-away view of the second embodiment of the multi-conductor cable connector.
Figure 6B:
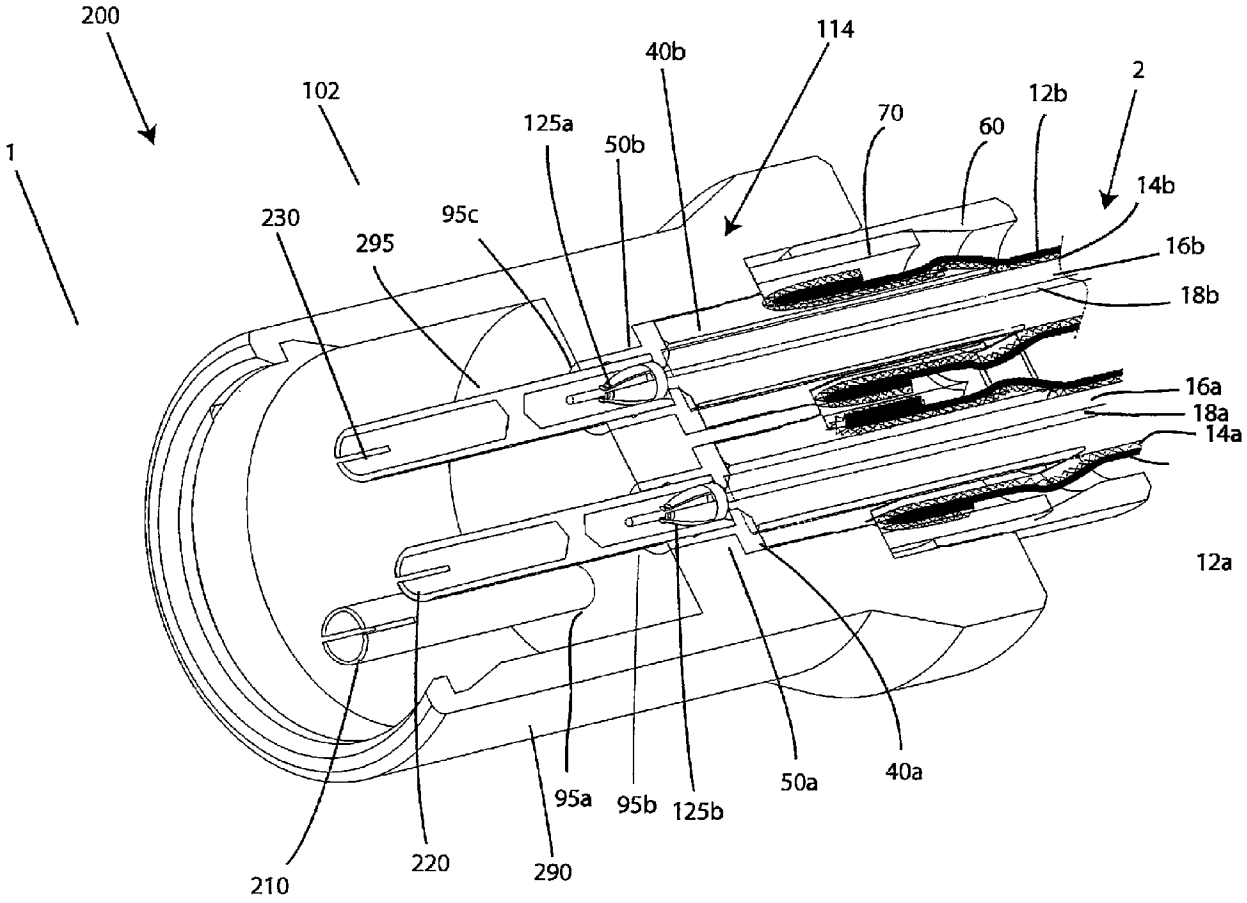
FIG. 6B depicts a perspective cut-away view of the second embodiment of the multi-conductor cable connector attached to at least two coaxial cables.

Moreover, the post 40*a*, 40*b* should be formed such that portions of a prepared coaxial cables 10*a*, 10*b* (as shown in FIGS. 5B and 6B) including the dielectric 16*a*, 16*b* (and possibly a conductive foil 15*a*, 15*b* tightly surrounding the interior dielectric 16*a*, 16*b*), and center conductive strand 18*a*, 18*b* can pass axially into the second 42*a*, 42*b* and/or through a portion of the tube-like body of the post 40*a*, 40*b*. Moreover, the post 40*a*, 40*b* should be dimensioned such that the post 40*a*, 40*b* may be inserted into an end of the prepared coaxial cables 10*a*, 10*b*, around the surrounding the dielectric 16*a*, 16*b* (and possible conductive foil 15*a*, 15*b*) and under the protective outer jackets 12*a*, 12*b* and the conductive strand layers 14*a*, 14*b*. Accordingly, where an embodiment of the post 40*a*, 40*b* may be inserted into an end of the prepared coaxial cables 10*a*, 10*b* under the drawn back conductive strand layer 14*a*, 14*b*, substantial physical and/or electrical contact with the conductive strand layer 14*a*, 14*b* may be accomplished thereby facilitating electrical continuity through the post 40*a*, 40*b*. The post 40*a*, 40*b* may be formed of metals or other conductive materials that would facilitate a rigidly formed post body. In addition, the post 40*a*, 40*b* may be formed of a combination of both conductive and non-conductive materials. For example, a metal coating or layer may be applied to a polymer of other non-conductive material. Manufacture of the post 40*a*, 40*b* may include casting, extruding, cutting, turning, drilling, knurling, injection molding, spraying, blow molding, component overmolding, or other fabrication methods that may provide efficient production of the component.

Referring still to FIGS. 3A-6B, an embodiment of a cable connection portion 114 of connector 100 may include a clamping element configured to seize, or otherwise clamp, the received first and second prepared coaxial cables 10*a*, 10*b*. Clamping element 70 may have a first end 71, a second end 72, an inner surface 73, and an outer surface 74. The clamping element 70 may be disposed around the received cables 10*a*, 10*b*. For example, the clamping element 70 may surround or partially surround the first and second coaxial cables 10, 10*b*, and the first and second post 40*a*, 40*b* configured to receive the cables 10*a*, 10*b*. The clamping element 70 may seize and/or clamp the received cables 10*a*, 10*b* for operable alignment and/or positioning during compression by the fastener member 60. For instance, the outer surface 74 clamping element 70 may provide a coopering engagement surface for the fastener member 60 to effectuate even compression of the connector 100, 200. In other words, the outer surface 74 of the clamping element 70 may cooperate with the inner surface 63 and ramped surface 66 of the fastener member 60. Those skilled in the art should appreciate that various means to seize the coaxial cable 10*a*, 10*b* may be implemented. Accordingly, the clamping element 70 may take various structural configurations to operably seize the cables 10*a*, 10*b*. Embodiments of the clamping element 70 may be a rubber or plastic grommet. For example, embodiments of the clamping element 70 may be a sleeved grommet disposed around the cables 10*a*, 10*b*. Additionally, the clamping element 70 may operably seize or otherwise clamp two or more coaxial cables 10*a*, 10*b* that do not share a parallel or substantially parallel orientation. For example, a first coaxial cable 10*a* may be received by clamping element 70 at a first angle/orientation, and a second coaxial cable 10*b* may be received by the clamping element 70 at a second, different angle orientation. The clamping element 70 may be formed of materials such as, polymers, bendable metals or composite materials that facilitate a semi-rigid, yet compliant component. Further, the clamping element 70 may be formed of conductive or non-conductive materials or a combination thereof. Manufacture of the clamping element 70 may include casting, extruding, cutting, turning, drilling, injection molding, spraying, blow molding, or other fabrication methods that may provide efficient production of the component.

Referring still to FIGS. 3A-6B, embodiments of a cable connection portion 114 of connector 100, 200 may include a fastener member 60. The fastener member 60 may have a first end 61, opposing second end 62, an inner surface 63, and an outer surface 64. In one embodiment, the fastener member 60 may be a compression ring or tubular cylindrical member. The fastener member 60 may be radially disposed over the clamping element 70. For example, the outer surface 74 of the clamping element 70 may physically contact the inner surface 63 of the fastener member 60. In addition, the fastener member 60 may comprise a central passageway 65 defined between the first end 61 and second end 62 and extending axially through the fastener member 60. The central passageway 65 may comprise a ramped surface 66 proximate or otherwise near the second end 62 which may be configured to mate with outer surface 74 of the clamping element 70. The ramped surface 66 may act to compress the outer clamping element 70 when the fastener member 60 is operated to secure at least two coaxial cables 10*a*, 10*b*. For example, the narrowing geometry will compress squeeze against the clamping element 70 and other components, when the fastener member 60 is compressed into a tight and secured position. The first end 61 of the fastener member 60 may extend an axial distance so that, when the fastener member 60 is compressed into sealing position, the fastener member or resides substantially within the connector body 90. It should be recognized, by those skilled in the requisite art, that the fastener member 60 may be formed of conductive or non-conductive rigid materials such as metals, hard plastics, polymers, composites and the like, and/or combinations thereof. Furthermore, the fastener member 60 may be manufactured via casting, extruding, cutting, turning, drilling, injection molding, spraying, blow molding, component overmolding, combinations thereof, or other fabrication methods that may provide efficient production of the component.

In one embodiment, the manner in which the cable connection portion 114 may be fastened to the at least two coaxial cables 10*a*, 10*b* may involve compaction of the clamping element 70, for example, by operation of a fastener member 60. For example, once received, or operably inserted into the connector 100, the at least two coaxial cables 10*a*, 10*b* may be securely set into position by compacting and deforming the outer surface 74 of clamping element 70 against the coaxial cables 10*a*, 10*b* thereby affixing the cable into position and sealing the connection. Compaction and deformation of the clamping element 70 may be effectuated by physical compression caused by a fastener member 60, wherein the fastener member 60 constricts and locks the clamping element 70 into place.

Referring still to FIGS. 3A-6B, further embodiments of cable connection portion 114 may also include a first insulator 50*a* configured to receive one of the electrical contacts, for example, the second electrical contact 120, 220, and a second insulator 50*b* configured to receive an electrical contact, for example, the third electrical contact 130, 230. The first insulator 50*a* and the second insulator 50*b* may share the same structural and functional aspects; thus, the first and second insulators 50*a*, 50*b* are described, in part as designated, as a singular component. However, those skilled in the requisite art should appreciate that connector 100, 200 may include two or more insulators for receiving two more electrical contacts. The insulator 50*a*, 50*b* may be a generally cylindrical member having an outwardly extending flange 55*a*, 55*b* and a generally axial opening therethrough. The first insulator 50*a* may be partially disposed within the second opening 95*b* of the connector body 90 (or second opening 34 of the conductive member 30) a distance until the bottom surface of the flange 55*a* contacts the connector body 90. The top surface of the flange 55*a* may abut, contact, engage, etc., the first edge 43*a* of the post 40*a* that is disposed proximate the second opening 95*b* of the connector body 90 (or the second opening 34 of the conductive member 30). The first insulator 50*a* can be press-fit within the opening 95*b* (or 34) to reduce or eliminate unwanted axial displacement within the opening. The second contact 120, 220 may then pass axially through (or into) the first insulator 50*a*. In other words, the first insulator 50*a* may be radially disposed over the second contact 120, 220, wherein the first insulator 50*a* is also axially disposed within the second opening 95*b* of the connector body 90 (or opening 34 of the conductive member 30). The axial opening through the first insulator 50*a* may be sized to effectuate sufficient tightness, fitting, and/or tolerances with the second electrical contact 120, 220, while the first insulator 50*a* (the body or the flange 55*a*) may be sized to effectuate sufficient tightness, fitting, and/or tolerances within the opening 95*b* of the connector body 90 (or opening 34 of the conductive member 30). Similarly, the second insulator 50*b* can be press-fit within the opening 95*c* of the connector body 90 (or opening 35 of the conductive member) to reduce or eliminate unwanted axial displacement within the opening 95*c*, 35. The third electrical contact 130, 330 may then pass axially through (or into) the second insulator 50*b*. In other words, the second insulator 50*b* may be radially disposed over the third electrical contact 130, 330, wherein the second insulator 50*b* is also partially or fully axially disposed within the third opening 95*c* of the connector body 90 (or opening 35 of the conductive member 30). The axial opening through the first insulator 50*b* may be sized to effectuate sufficient tightness, fitting, and/or tolerances with the third electrical contact 130, 330, while the second insulator 50*b* (the body or the flange 55*b*) may be sized to effectuate sufficient tightness, fitting, and/or tolerances for the portion of the insulator 50*b* within the opening 95*c* of the connector body 90 (or opening 35 of the conductive member 30.

Moreover, the first insulator 50*a*, 50*b* should be made of non-conductive materials, such as an insulating material. Because the insulator 50*a*, 50*b* is made of insulating materials, the insulator 50*a*, 50*b* may electrically isolate the electrical paths through the connector 100, 200. For example, the first insulator 50*a* may electrically isolate the second electrical contact 120, 220 or path from the conductive member 30 and either the first post 40*a* (or the first conductive strand layer 14*a*), while making physical contact with the connector body 90 (or the conductive member 30) and the first post 40*a*. The second insulator 50*b* may electrically isolate the third electrical contact 130, 330 or path from the conductive member 30 and the second post 40*b* (or second conductive strand layer 14*b*), while making physical contact with the connector body 90 (or the conductive member 30) and the second post 40*b*.

Manufacture of the insulator 50*a*, 50*b* may include casting, extruding, cutting, turning, drilling, compression molding, injection molding, spraying, or other fabrication methods that may provide efficient production of the component.

As described herein above with respect to the cable connection portion 114 of embodiments of a multi-conductor cable connector 100, similar structural and functional integrity may be maintained for similar component elements of a cable connection portion 214 of embodiments of a multi-conductor cable connector 200. The various component elements of a cable connection portion 114 of a multi-conductor cable connector 100, may be substantially similar in design and operability both separately and as assembled in a corresponding cable connection portion 214 of a multi-conductor cable connector device 200.

Referring now to FIGS. 3A and 4-5B, embodiments of a multi-conductor cable connector 100 may include a multi-contact portion 113. The multi-contact portion 113 may include a connector body 90, a first contact 110, a second contact 120, and a third contact 130. Multi-contact portion 113 may be any multi-conductor plug, such as an XLR, XLR3, any XLR type plug/cable, phone plug, audio plug, stereo plug, and the like.

Embodiments of a multi-contact portion 113 may include a connector body 90. The connector body 90 may be in electrical communication with at least one of (or both) the conductive strand layer 14*a*, 14*b* of the first and second coaxial cables 10*a*, 10*b* to extend a continuous ground/shield through the connector 100. The connector body 90 may have a first end 91, a second end 92, an inner surface 93, and an outer surface 94. The connector body 90 can have a generally axial opening from the first end 91 to a contact plate portion 95, which includes a plurality of openings 95*a*, 95*b*, 95*c*, and then another generally opening from the contact plate portion 95 to the second end 92. In embodiments of the multi-contact portion 113, 213 that include a separate conductive component, such as a conductive member 30, to establish an electrical ground path, the inner diameter of the connector body 90 may be large enough to allow a conductive member 30 to pass axially through the second end 92, or dimensioned such that the conductive member 30 may reside substantially within the connector body 90 proximate or otherwise near the second end 92. Moreover, the connector body 90 may include an internal lip 96 located within the generally axial opening of the connector body 90.

Moreover, the connector body 90 may include a plurality of openings 95*a*, 95*b*, 95*c* configured to accommodate the plurality of electrical contacts 110, 120, 130, 210, 220, 230, and a portion of a first and second insulator 50*a*, 50*b*. For instance, the connector body 90 may include first opening 95*a*, configured to receive a first electrical contact 110, 210. The contact between the first electrical contact 110, 210 and the connector body 90 may extend a ground through the connector 100, 200. Embodiments of connector body 90 may include a second opening 95*b*, configured to receive a portion of the first insulator 50*a*, wherein the second electrical contact 120, 220 enters the first insulator 50*a*. The physical and electrical contact between the second electrical contact 120, 220 (possibly via a first socket 125) and the center conductive strand 18*a* of the first coaxial cable 10*a* may extend a first continuous electrical path through the connector 100, 200. Embodiments of the connector body 90 may include a third opening 95*c*, configured to receive a portion of the second insulator 50*b*, wherein the third electrical contact 130, 230 enters the second insulator 50*b*. The physical and electrical contact between the third electrical contact 130, 230 (possibly via a second socket 135) and the center conductive strand 18*b* of the first coaxial cable 10*b* may extend a second continuous electrical path through the connector 100, 200. The plurality of openings 95*a*, 95*b*, 95*c* may be located on a portion of the connector body 90, such as a contact plate 95 that extends radially inward towards a central axis of the connector 100, 200. The contact plate 95 is structurally integral with the connector body 90, and may annularly extend around the inner surface 93 of the connector body 90. In other words, a face, or surface, of the contact plate 95 may be perpendicular or substantially perpendicular to the inner surface 93 of the connector body 90.

Furthermore, embodiments of the one or more openings 95*a*, 95*b*, 95*c* of connector body 90 may have any orientation that may correspond with the structural positioning of the plurality of electrical contacts 110, 120, 130, or 210, 220, 230. Any of the openings 95*a*, 95*b*, 95*c* may be larger than the other. For example, the third opening 95*c* may have a larger diameter than the second opening 95*b* to accommodate larger diameter contacts. Moreover, the connector 100, 200 may have various non-concentric alignments of the electrical contacts 110, 120, 130, or 210, 220, 230. In one embodiment, the non-concentric alignment of the contacts 110, 120, 130 or 210, 220, 230 may resemble an isosceles or right triangle. Accordingly, the structural location of the openings 95*a*, 95*b*, 95*c* of the connector body 90 may change to accommodate the various alignments of the plurality of electrical contacts, such as contacts 110, 120, 130 or 210, 220, 230. Because there may be various non-concentric alignments of the contacts 110, 120, 130, or 210, 220, 230, the positioning of the openings 95*a*, 95*b*, 95*c* may vary. For example, in one embodiment, the second opening 95*b* and the third opening 95*c* are positioned in a side-by-side alignment. Because the first and second post 40*a*, 40*b* are in physical and electrical contact with the drawn back and exposed conductive strand layer 14*a*, 14*b*, respectively, the physical and electrical contact between at least one of (or both) the first post 40*a* (e.g. thicker portion 45*a*) and the second post 40*b* (e.g. thicker portion 45*b*) and the connector body 90 establishes and maintains a continuous electrical ground/shield path between the connector body 90 and at least one of (or both) the first post 40*a* and the second post 40*a*. Alternatively, physical and electrical contact between at least one of (or both) the conductive strand layers 14*a*, 14*b* of the first and second coaxial cables 10*a*, 10*b* and the connector body 90 establishes and maintains a continuous electrical ground/shield path between the connector body 90 and at least one of (or both) the conductive strand layers 14*a*, 14*b* of the first and second coaxial cables 10*a*, 10*b*.

Furthermore, connector body 90 may include an annular recess 97 located proximate or otherwise near the first end 91. The connector body 90 may also include a tapered surface 98 which resides proximate or otherwise near the outer annular recess 97. The combination of the annular recess 97 and the second inner diameter may lead to a smaller thickness proximate or otherwise near the first end 91 than the thickness proximate the second end 92. Moreover, an opening 99, 199 may be located on the outer rim of the connector body 90 proximate or otherwise near the first end 91. The opening 99 may accept, receive, engage, interact with a shaft-like spline of a female type connector to ensure that the male multi-conductor cable connector 101 twists, moves, rotates, etc. with a female multi-conductor cable connector 102 when movement occurs. The opening 99, 199 may be a notch, groove, channel, and the like. Additionally, a portion of the first, second, and third contacts 110, 120, 130 may be located within the general axial opening of the connector body 90, while the remaining portion of the contacts 110, 120, 130 may enter the cable connection portion 114. The connector body 90 may be formed of conductive or non-conductive materials, or a combination of conductive and non-conductive materials. For example the outer or external surface 94 of the connector body 90 may be formed of a polymer, while the remainder of the connector body 90 may be comprised of a metal or other conductive material to extend a shield through the connector 100, 200. Specifically, physical contact between the conductive portion of the connector body 90 and the first and second post 40*a*, 40*b* (or conductive member 30) may extend a continuous RF shield through the connector 100, 200. The connector body 90 can be formed of metals (or other suitable conductive material) or a combination of metals and polymers. Embodiments of connector body 90 may be a male connector body 190 or a female connector body 290. The male connector body 190 may be substantially similar to the structure and function of embodiments of connector body 90 described supra.

Figure 3A:
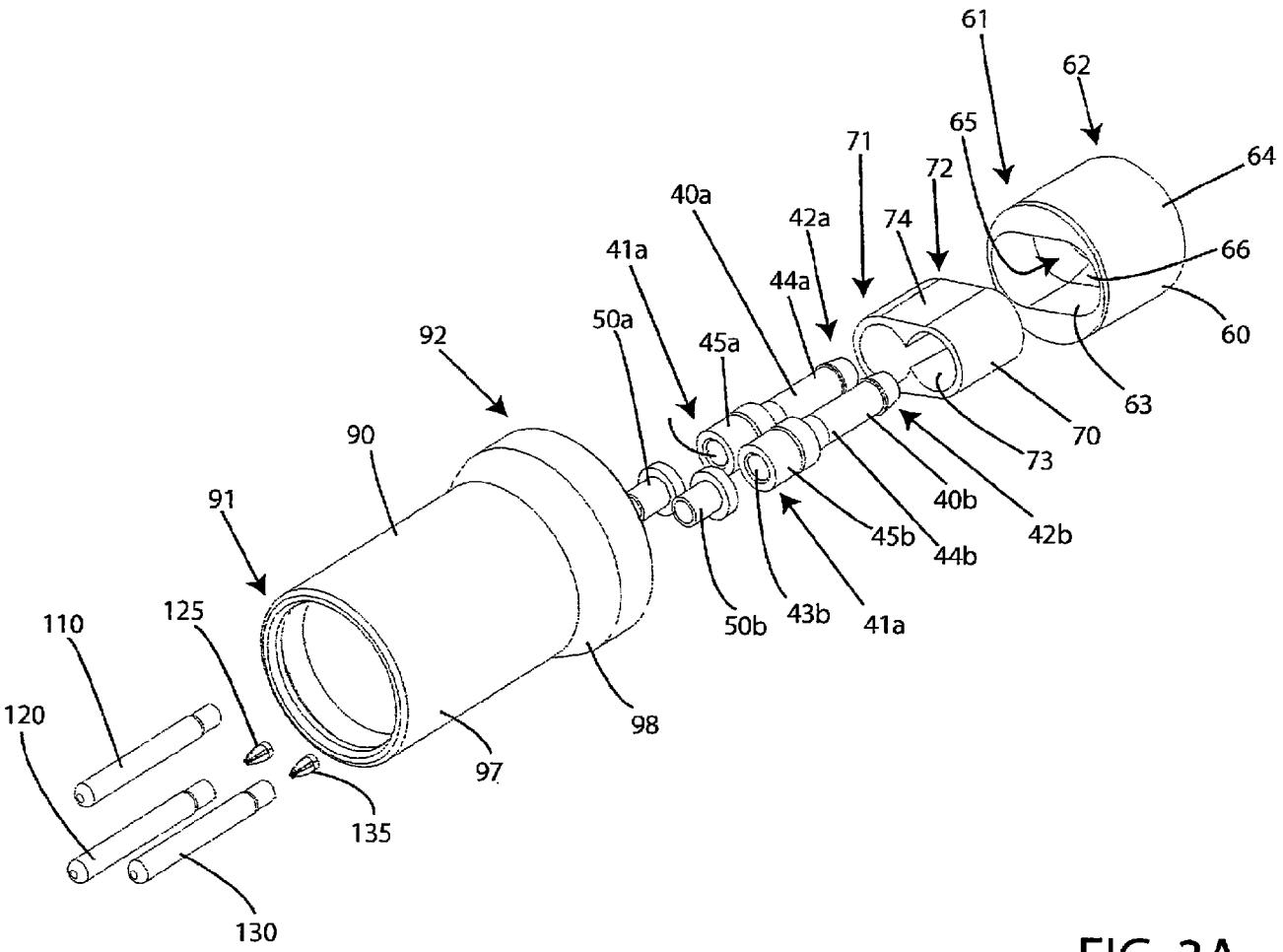
FIG. 3A depicts an exploded perspective view of the first embodiment of the multi-conductor cable connector.
Figures 3B, 3C:
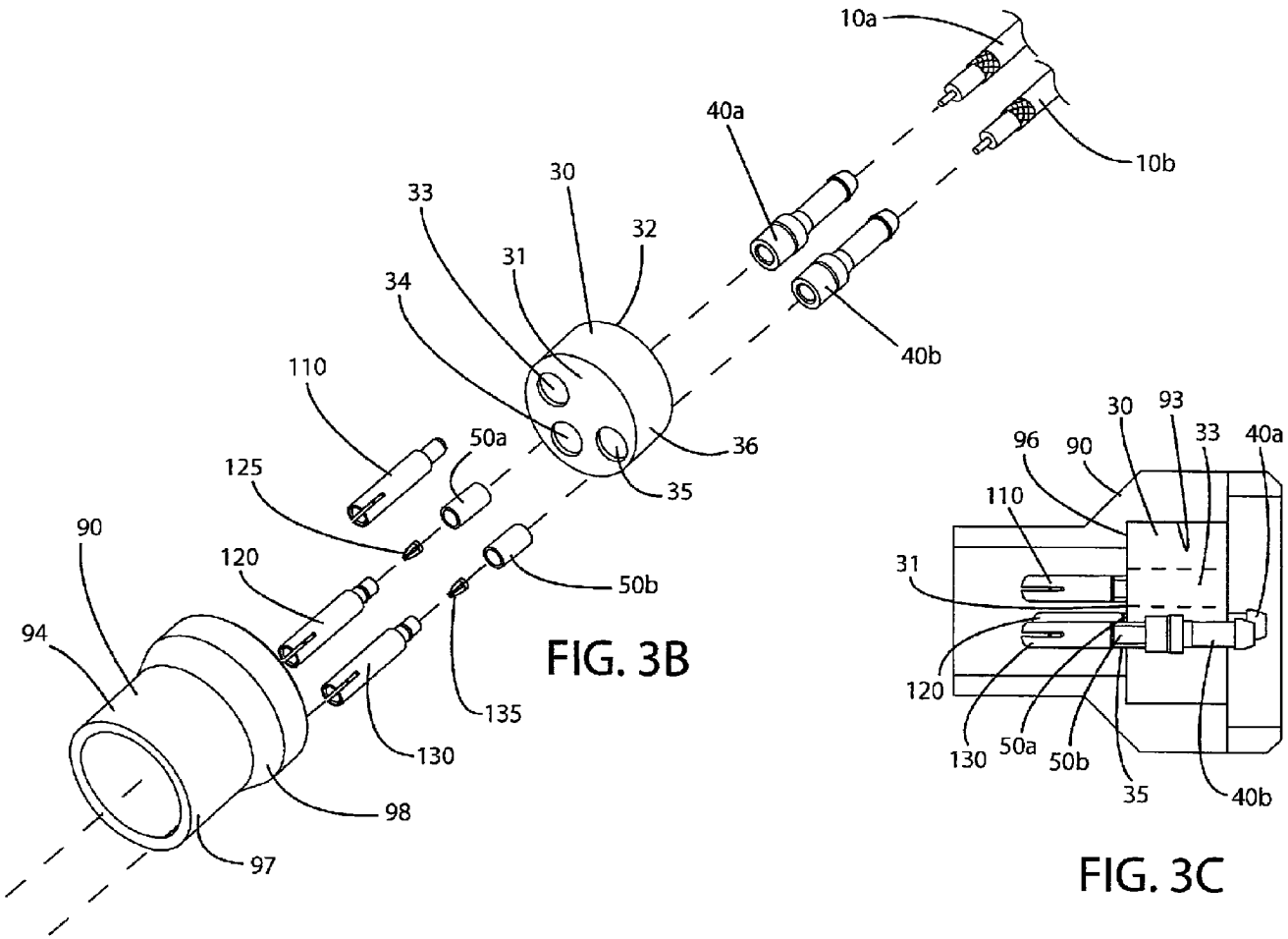
FIG. 3B depicts an exploded perspective view of an alternative embodiment of the first embodiment of the multi-conductor cable connector.
FIG. 3C depicts a cross-section view of an alternative embodiment of the first embodiment of the coaxial cable connector proximate a first end of the connector.

With reference now to FIGS. 3B and 3C, embodiments of a cable connection portion 114 may include a conductive member 30. The conductive member 30 may have a first surface 31 and a second surface 32, wherein the first surface 31 faces the first end 1 of the connector 100, 200, and the second surface 32 faces the second end 2 of the connector 100, 200. The conductive member 30 may be disposed within a generally axial opening of the connector body 90, proximate the second end 92 of the connector body 90. While operably configured (i.e. connector in a compressed position), the conductive member 30 can physically contact the connector body 90 to extend a continuous ground/shield through connector 100, 200. Embodiments of conductive member 30 may engage an internal lip 96 of the connector body 90 to extend a RF shield through the connector 100, 200, as shown in FIG. 3C. Moreover, the conductive member 30 may include a plurality of openings configured to accommodate the plurality of electrical contacts 110, 120, 130, 210, 220, 230, a first and second insulator 50*a*, 50*b*, and/or a portion of the first and second post 40*a*, 40*b*. For instance, the conductive member 30 may include first opening 33, configured to receive a first electrical contact 110, 210. The contact between the first electrical contact 110, 210 and the conductive member 30 may extend a ground through the connector 100, 200. Embodiments of conductive member 30 may include a second opening 34, configured to receive a first insulator 50*a* and a portion of the first post 40*a* proximate the first end 41*a*, wherein the second electrical contact 120, 220 enters the first insulator 50*a*. The physical and electrical contact between the second electrical contact 120, 220 (possibly via a first socket 125) and the center conductive strand 18*a* of the first coaxial cable 10*a* may extend a first continuous electrical path through the connector 100, 200. Embodiments of the conductive member 30 may include a third opening 35, configured to receive a second insulator 50*b* and a portion of the first post 40*b* proximate the first end 41*b*, wherein the third electrical contact 130, 230 enters the second insulator 50*b*. The physical and electrical contact between the third electrical contact 130, 230 (possibly via a second socket 135) and the center conductive strand 18*b* of the first coaxial cable 10*b* may extend a second continuous electrical path through the connector 100, 200.

Furthermore, embodiments of the one or more openings 33, 34, 35 of conductive member 30 may have any orientation that may correspond with the structural positioning of the plurality of electrical contacts 110, 120, 130, or 210, 220, 230. Any of the openings 33, 34, 35 may be larger than the other. For example, the third opening 35 may have a larger diameter than the second opening 34 to accommodate larger diameter contacts. Moreover, the connector 100, 200 may have various non-concentric alignments of the electrical contacts 110, 120, 130, or 210, 220, 230. In one embodiment, the non-concentric alignment of the contacts 110, 120, 130 or 210, 220, 230 may resemble an isosceles or right triangle. Accordingly, the structural location of the openings 33, 34, 35 of the conductive member 30 may change to accommodate the various alignments of the plurality of electrical contacts, such as contacts 110, 120, 130 or 210, 220, 230. Because there may be various non-concentric alignments of the contacts 110, 120, 130, or 210, 220, 230, the positioning of the openings 33, 34, 35 may vary. For example, in one embodiment, the second opening 34 and the third opening 35 are positioned in a side-by-side alignment. To achieve various non-concentric alignments of the contacts 110, 120, 130, or 210, 220, 230 the structural positions of the connector body 90 and the conductive member 30 may have to be correspondingly modified to accommodate different contact 110, 120, 130, or 210, 220, 230 alignments.

Additionally, the conductive member 30 may include an outer edge mating surface 36 which faces the inner surface 93 of the connector body 90. While operably configured, the mating surface 36 may abut, contact, communicate, border, touch, press against, and/or adjacently join with the inner surface 93 of the connector body 90 to extend an electrical path, such as a RF shield through the connector body 90. Because the first and second post 40*a*, 40*b* are in physical and electrical contact with the drawn back and exposed conductive strand layer 14*a*, 14*b*, respectively, the physical and electrical contact between at least one of (or both) the first post 40*a* (e.g. thicker portion 45*a*) and the second post 40*b* (e.g. thicker portion 45*b*) and the conductive member 30 (e.g. thicker portion 45*a* press-fit within second opening 34 and/or thicker portion 45*b* press-fit within the third opening 35) establishes and maintains a continuous electrical ground/shield path between the conductive member 30 and at least one of (or both) the first post 40*a* and the second post 40*a*. Alternatively, physical and electrical contact between at least one of (or both) the conductive strand layers 14*a*, 14*b* of the first and second coaxial cables 10*a*, 10*b* and the conductive member 30 establishes and maintains a continuous electrical ground/shield path between the conductive member 30 and at least one of (or both) the conductive strand layers 14*a*, 14*b* of the first and second coaxial cables 10*a*, 10*b* a. Moreover, the conductive member 30 should be formed of conductive materials. Manufacture of the conductive member 30 may include casting, extruding, cutting, turning, rolling, stamping, photo-etching, laser-cutting, water-jet cutting, and/or other fabrication methods that may provide efficient production of the component.

Figure 4A:
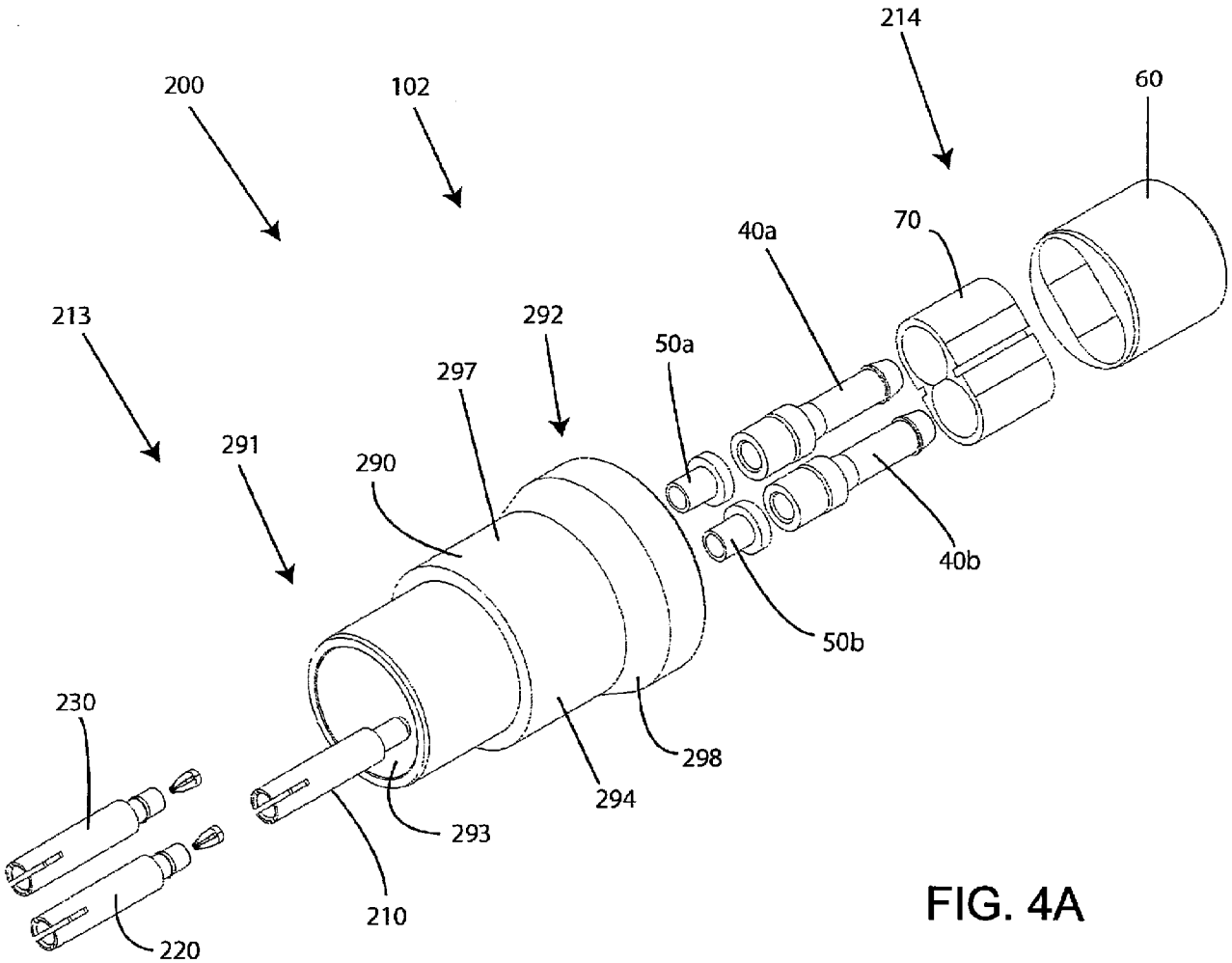
FIG. 4A depicts an exploded perspective view of the second embodiment of the multi-conductor cable connector.
Figure 4B:
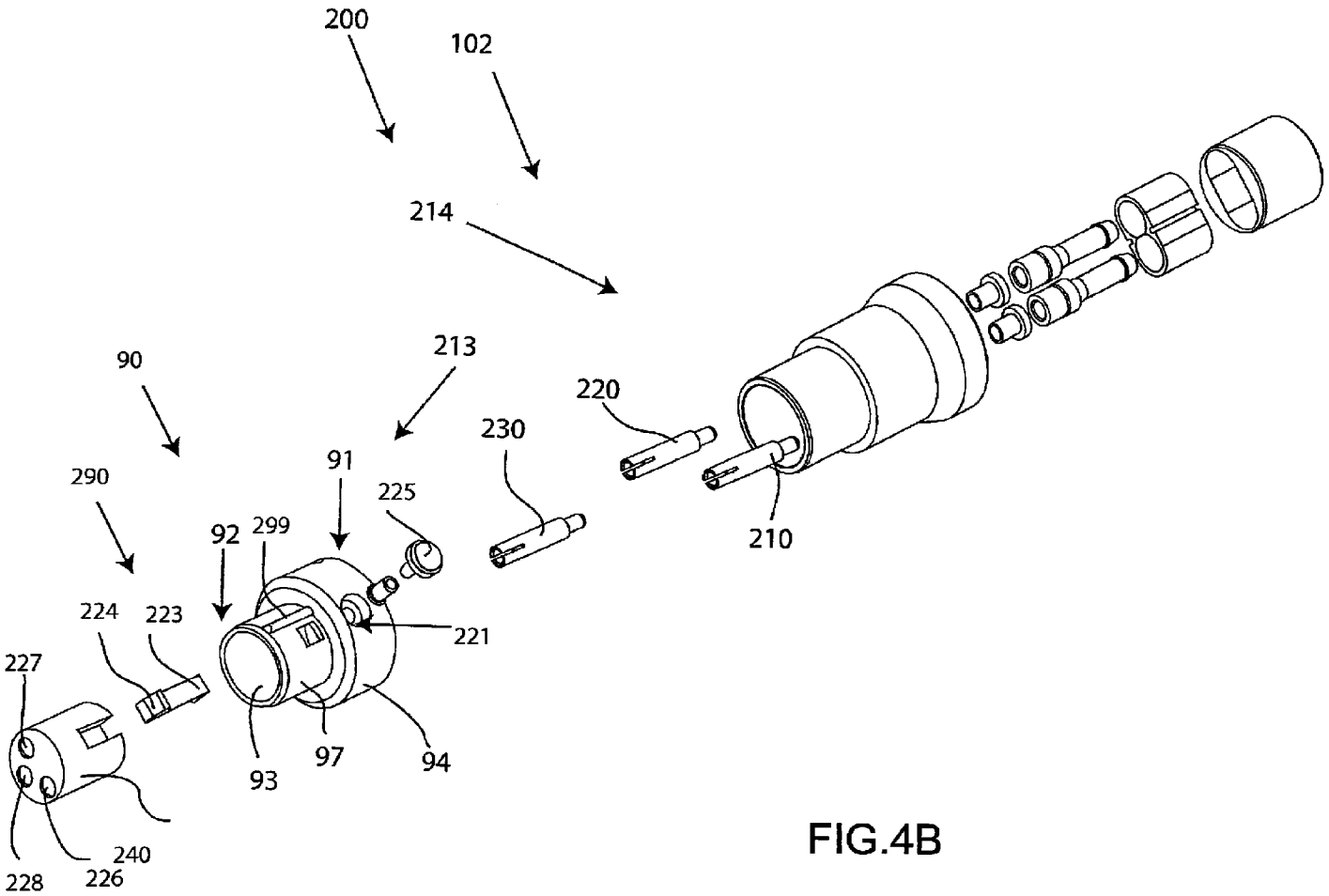
FIG. 4B depicts an exploded perspective view of an alternative embodiment of the second embodiment of the multi-conductor cable connector.

Referring now to FIGS. 4A and 6A-6B, embodiments of a multi-conductor cable connector 200 is depicted. The multi-conductor cable connector embodiment 200 may have several similar features with a multi-conductor cable connector embodiment 100. However, the embodiment of a multi-conductor cable connector 200 may be a female connector 102. As such, the multi-conductor cable connector 200 may include a female connector body 290. FIG. 4B depicts an embodiment of female type connector 201. Embodiments of connector 201 can include a female connector body 290 sharing some structure and function of the connector body 90, but may include additional or different structural and/or functional aspects. For instance, the female connector body 290 of connector 201 may include a spline located on the outer surface 294 of the female connector body 290 to ensure cohesive and concurrent movement between the male and the female connector 101, 102. The female connector body 290 of connector 201 may also include a contact receiver 240, and a securing means 221. The contact receiver 240 may include a plurality of openings that may accept, accommodate, receive, support, and/or guide a plurality of contacts, such as the first, second, and third contacts 110, 120, 130. In most embodiments, the plurality of openings may include a first receptive contact opening 226, which corresponds to the first contact 110, a second receptive contact opening 227, which corresponds to the second contact 120, and a third receptive contact opening 228 which corresponds to the third contact 130. The orientation of the first, second, and third receptive contact openings 226, 227, 228 may correspond to the non-concentric alignment of the contacts 110, 120, 130. The contact receiver 240 may be positioned within or substantially within the female connector body 290 proximate a first end 291. In other words, the female connector body 290 may surround or substantially surround the contact receiver 240. In one embodiment, the contact receiver 240 fits snugly within the female connector body 290. The contact receiver 240 should be formed of non-conductive materials, such as rubber or other polymeric material. Manufacture of the contact receiver 240 may include casting, extruding, cutting, turning, drilling, compression molding, injection molding, spraying, or other fabrication methods that may provide efficient production of the component.

Furthermore, embodiments of the female connector body 290 of connector 201 may include a securing means 221. Securing means 221 may be a latching mechanism having a latch arm 223 and latch head 224. Securing means 221 may be any other securing means operable with a multi-conductor cable connector. Embodiments of latch head 224 may have a ramped surface(s) to releasably engage the male connector body 190. A lock button 225 may be operably associated with the latch arm 223 and latch head 224 to releasably secure the male multi-conductor cable connector 101 to the female multi-conductor cable connector 102. The lock button 225 may be exposed and/or accessible on the outer surface 294 of the female connector body 290. Those skilled in the art should appreciate that securing means 221 may be a variety of securing means typically associated with multi-conductor cables, such as XLR type cables.

Figure 9:
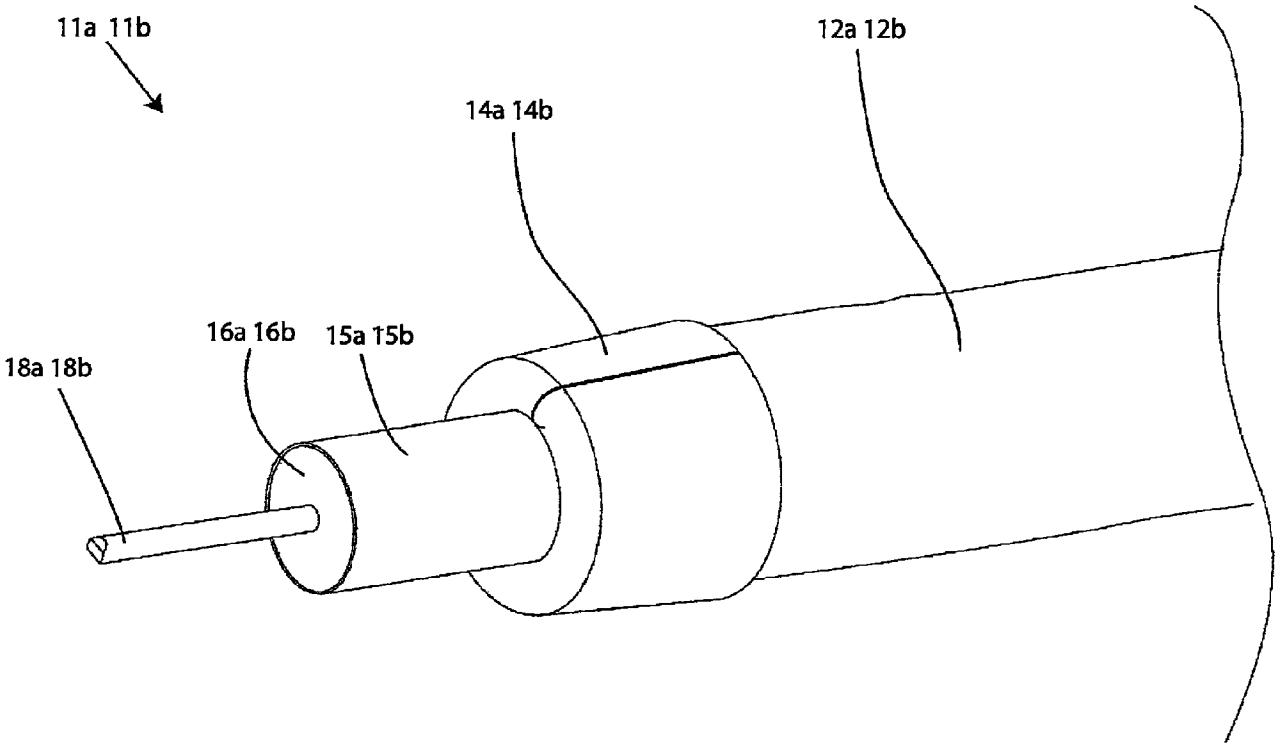
FIG. 9 depicts a perspective view of a second embodiment of a coaxial cable having a plurality of conductive strands concentrically sharing a common central axis.

Referring back to FIGS. 3A and 5A-5B, embodiments of a multi-contact portion 113 may include a first contact 110, a second contact 120, and a third contact 130. A contact may be a conductive element that may extend or carry an electrical current and/or signal from a first point to a second point. A contact may be a terminal, a pin, a conductor, an electrical contact, and the like. Contacts 110, 120, 130 may have various diameters, sizes, and may be arranged in any non-concentric alignment throughout the connector 100. Furthermore, a contact, such as the first, second, and third contacts 110, 120, 130 may be both female and male. The male electrical contacts may include spikes, or similar pointed protrusion, which may be configured to insert into the center conductive strand 18*a*, as depicted in FIG. 6B. In contrast, the female electrical contact may include sockets, or similar receptacle, which may be configured to receive an exposed, protruding center conductive strand 18*b*, as depicted in FIG. 9. Thus, electrical contacts which are male and female may include a socket element at one end to receive, and a spike element at the opposing end. Furthermore, a first contact 110 may extend a continuous electrical ground path through the connector 100. In one embodiment, a first end, or portion, of the first contact 110 may be positioned within the first opening 95*a* of the connector body 90 (or opening 33 of the conductive member 30) of the male connector 101, and a second end, or portion, may be inserted into the first receptive contact opening 226 of the female connector 102. A second contact 120 may extend a continuous electrical path through the connector 100. In one embodiment, a first end, or portion, of the second contact 120 may be positioned within the second opening 95*b* of the connector body 90 (or the opening 34 of the conductive member 30 of the male connector 101, and a second end, or portion, may be inserted into the second receptive contact opening 227 of the female connector 102. Moreover, a third contact 130 may extend a continuous electrical path through the connector 100. In one embodiment, a first end, or portion, of the third contact 130 may be inserted through the third opening 95*c* of the connector body 90 (or the third opening 35 of the conductive member 30) of the male connector 101, and a second end, or portion, may be inserted into the third receptive contact opening 228 of the female connector 102.

With continued reference to the drawings, FIGS. 5A-5B depict embodiments of a multi-conductor cable connector 100 which includes a multi-contact portion 113 and a cable connection portion 114. Coupling the cable connection portion 114 with the multi-conductor multi-contact portion 113 may provide a plurality of electrical paths through the connector 100 while avoiding the hassles and dangers of soldering separate wires associated with the conductors. For example, the cable connection portion 114 involves straightforward coaxial cable 10*a*, 10*b* preparation (e.g. drawing back the jackets 12*a*, 12*b* of each of the plurality of coaxial cables) instead of soldering methods, saving time during installation, while also achieving high strength, low stress bonding to the contacts 110, 120, 130 of the connector 100. Furthermore, the multi-conductor multi-contact portion 113 non-concentrically aligned with the cable connection portion 114 reduces the possibility of mis-wiring the contacts of the connector 100 because the order of termination of the contacts, such that the first, second, and third contacts 110, 120, 130, are "hard-wired" into the cable connection portion 114 (i.e. no need to spend time repeatedly executing precautionary steps to avoid mistakes while soldering). Using a two or more coaxial cables 10*a*, 10*b* utilizes the benefits of shielding from external interference or cross-talk, but does not require a special prep tool as a triaxial or similar cable requires. In addition, coaxial cables reduce the size of the connector compared to a connector utilizing a triaxial cable, and the coaxial cables are more flexible than a triaxial cable.

Figure 7:
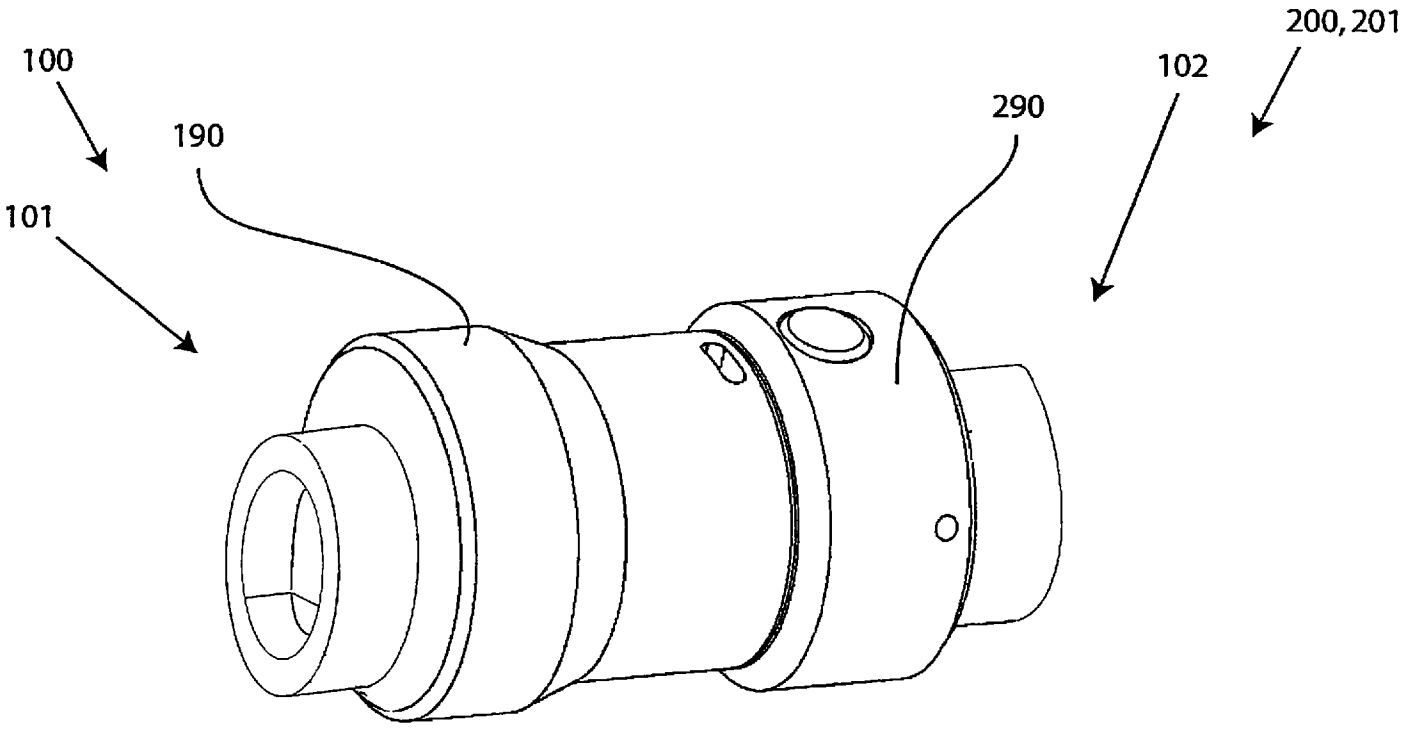
FIG. 7 depicts a perspective view of the first embodiment of the multi-conductor cable connector in a mated position with the second embodiment of the multi-conductor cable connector (coaxial cables not shown).

The electrical paths through the connector 100, 200 are now further described with reference to FIG. 5B. A first electrical path or electrical ground path may be associated with the first contact 110. The first and second coaxial cables 10*a*, 10*b* include a conductive strand layer 14*a*, 14*b*, respectively, that carries an electrical current or signal, and may be drawn back and exposed, as depicted in FIGS. 2 and 9. While operably configured, the first and second post 40*a*, 40*b*, physically and electrically contacts the conductive strand layer 14*a*, 14*b* to extend a continuous electrical ground path between them. At least one of or both the first and second post 40*a*, 40*b* may physically and electrically contact the connector body 90 (or a conductive member 30) which may extend a continuous electrical ground path between them. Alternatively, at least one of or both the first and second conductive strand layers 14*a*, 14*b* may physically and electrically contact the connector body 90 (or the conductive member 30) which may extend a continuous electrical ground path between them. Moreover, an end of the first contact 110 physically and electrically contacts the connector body 90 (or the conductive member 30) while inserted into the first opening 95*a* (or first opening 33). While in a mated position, as depicted in FIG. 7, the first contact 110 of a male connector 101 may be received by the first receptive contact opening 226 of the contact receiver 240 of a female connector 102, extending a continuous electrical ground path therebetween.

A second electrical path through the connector 100 may be associated with a second contact 120. A first coaxial cable 10*a* of the two or more coaxial cables may include a center conductive strand 18*a*, which carries an electrical current or signal, and may be surrounded by a dielectric 16*a*, as depicted in FIG. 2. While operably configured, an end of the second electrical contact 120 is in electrical communication with the center conductive strand 18*a*. In one embodiment, a spike of the contact 120 engages, pierces, pokes, etc., or pushes into the center conductive strand 18*a*. In another embodiment, a first socket element 125 receives the center conductive strand 18*a*, wherein the first socket 125 is press-fit or otherwise attached within the electrical contact 120. While in a mated position, as depicted in FIG. 7, the second contact 120 of a male connector 101 may be received by the second receptive contact opening 227 of the contact receiver 240 of a female connector 102, extending a continuous electrical path therebetween.

A third electrical path through the connector 100 may be associated with a third contact 130. A second coaxial cable 10*b* of the two or more coaxial cables may include a center conductive strand 18*b*, which carries an electrical current or signal, and may be surrounded by a dielectric 16*b*, as depicted in FIG. 2. While operably configured, an end of the third electrical contact 130 is in electrical communication with the center conductive strand 18*b*. In one embodiment, a spike of the contact 130 engages, pierces, pokes, etc., or pushes into the center conductive strand 18*b*. In another embodiment, a second socket element 135 receives the center conductive strand 18*b*, wherein the second socket 135 is press-fit or otherwise attached within the electrical contact 130, as depicted in. While in a mated position, as depicted in FIG. 7, the third contact 130 of a male connector 101 may be received by the third receptive contact opening 228 of the contact receiver 240 of a female connector 102, extending a continuous electrical path therebetween.

Figure 8:
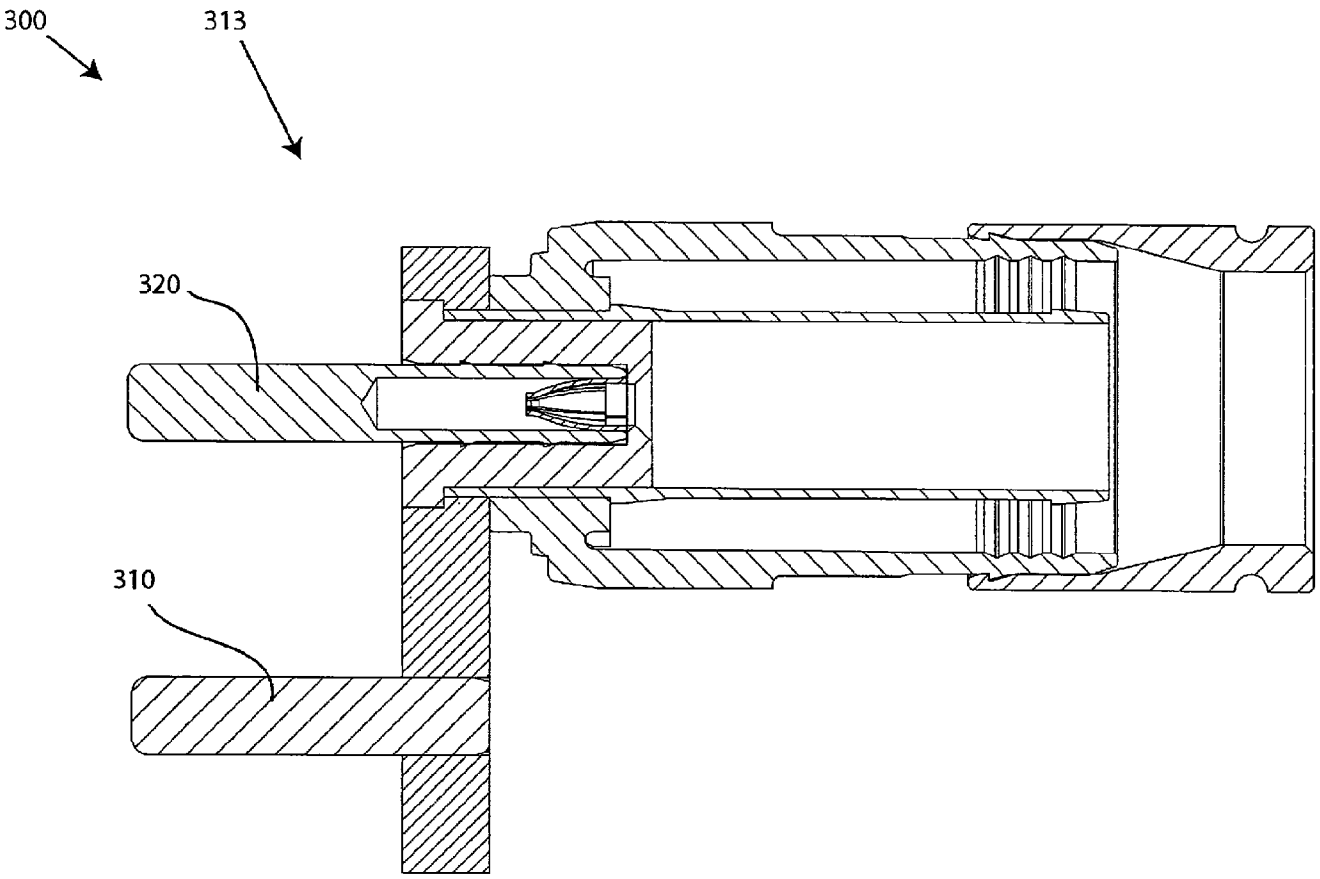
FIG. 8 depicts a perspective cut-away view of a third embodiment of the multi-conductor cable connector.

Referring to FIG. 8, embodiments of a multi-conductor cable connector 300 may include a multi-contact portion 313 and a cable connection portion 314; the multi-contact portion 313 may be coupled to the cable connection portion 314. The cable connection portion 314 may receive one or more coaxial cables 10*a*, 10*b* as described supra. Embodiments of the cable connection portion 314 may be similar or substantially similar to the structure and function as provided for the embodiments associated with connector 100, 200.

However, connector 300 may include a multi-contact portion 314 having less than three electrical contacts, such as a connector having two electrical contacts. For example, a multi-contact portion 313 of a multi-conductor cable connector 300 may include a first contact 310 and a second contact 320. In one non-limiting example, the first contact 310 and the second contact 320 may be banana plugs spaced apart from each other to correspond to a banana jack or banana receptacle on a speaker system. It should also be appreciated that a multi-contact portion of a multi-conductor cable connector may have more than three conductors, such as a connector having four electrical contacts. In embodiments having more than four electrical contacts, more than two coaxial cables may be received and utilized by a cable connection portion similar to the cable connection 114 as described herein With reference to FIG. 9, connectors 100, 200, 300 may be configured to receive a first embodiment of a coaxial cable 10*a*, 10*b*, or receive a second embodiment of a coaxial cable 11*a*, 11*b*. The coaxial cable 11*a*, 11*b* may share the same structure and features of coaxial cable 10*a*, 10*b*, except that coaxial cable 11*a*, 11*b* may have a center conductive strand 18*a*, 18*b* which protrudes from the dielectric 16*a*, 16*b*. For instance, the center conductive strand 18*a*, 18*b* may protrude and/or extend from the dielectric 16*a*, 16*b* and enter a socket of a female type electrical contact. The coaxial cable 11*a*, 11*b* may be prepared similar to the coaxial cable 10*a*, 10*b*, with further preparation of the coaxial cable 11*a*, 11*b* including stripping the dielectric 16*a* (and potentially conductive foil layer) to expose a portion of the center conductive strand 18*a*, 18*b*.

Referring now to FIGS. 1-9, an embodiment of a method of forming a multi-conductor cable connector 100, 200, 300 connection is discussed. The method comprises a step of method of forming a multi-conductor cable connection, the method comprising: providing a multi-conductor cable connector 100, 200, 300, the multi-conductor cable connector 100, 200, 300 including: a cable connection portion 114, 214, 314, wherein the cable connection portion 114, 214, 314 receives at least two prepared coaxial cables 10*a*, 10*b* having a plurality of conductive strands 14*a*, 14*b* concentrically sharing a common central axis; and a multi-contact portion 113, 213, 313 coupled to the cable connection portion 114, 214, 314, the multi-contact portion 113, 213, 313 having a plurality of contacts 110, 120, 130, 210, 220, 230 non-concentrically aligned with the cable connection portion 114, 214, 314. An additional method step of forming a multi-conductor cable connector 100, 200, 300 includes mating the multi-conductor cable connector 100, 200, 300 with a separate device (not shown), the separate device having a corresponding plurality of mating electrical contacts (for mating with the contacts 110, 120, 130 or 210 220, 230, or 310, 320, 330), to complete the electrical connection, which completed electrical connection effectively extends through the embodiment of the multi-conductor cable connector 100, 200, 300.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

The following is claimed:

1. A multi-conductor cable connector comprising:

a cable connection portion configured to at least partially receive at least two prepared coaxial cables, the cable connection portion including:

a clamping element configured to clamp a portion of the at least two prepared coaxial cables; and a fastener member configured to compress at least a portion of the clamping element onto a portion of each of the at least two prepared coaxial cables;

a multi-contact portion coupled to the cable connection portion, the multi-contact portion having a plurality of contacts;

wherein each contact of the plurality of contacts extends along a different axis; and wherein at least one of the plurality of contacts is configured to establish an electrical ground path through the multi-contact portion, the electrical ground path electrically coupling the at least two prepared coaxial cables to one another.

2. The multi-conductor cable connector of claim 1, wherein the cable connection portion further includes:

a first post configured to receive one of the at least two prepared coaxial cables;

a second post configured to receive one of the at least two prepared coaxial cables; and wherein the clamping element is configured to seize a portion of each of the at least two prepared coaxial cables.

3. The multi-conductor cable connector of claim 1, wherein the multi-contact portion includes a conductive member disposed within a connector body, the conductive member further including a plurality of openings.

4. The multi-conductor cable connector of claim 1, wherein each of the at least two prepared coaxial cables includes an inner conductor, a dielectric surrounding the inner conductor, and a conductive strand braid surrounding the dielectric.

5. The multi-conductor cable connector of claim 1, wherein the multi-contact portion includes a connector body electrically and mechanically coupled with a post, the connector body including a plurality of openings.

6. The multi-conductor cable connector of claim 1, wherein the electrical ground path comprises a continuous ground shield.

7. The multi-conductor cable connector of claim 1, wherein the fastener member is configured to surround the at least a portion of the clamping element.

8. A multi-conductor coaxial cable connector comprising:

a cable connection portion, wherein the cable connection portion comprises:

a first post configured to receive a portion of a first prepared coaxial cable;

a second post configured to receive a portion of a second prepared coaxial cable;

a clamping element configured to seize a portion of the first and second prepared coaxial cables; and a fastener member configured to compress a portion of the clamping element;

a multi-contact portion coupled to the cable connection portion, the multi-contact portion having a plurality of electrical contacts, wherein each contact of the plurality of electrical contacts extends on a different axis; and a connector body configured to be in electrical communication with at least one conductive strand braid of the first and the second prepared coaxial cable and is configured to extend a shield through the multi-conductor coaxial cable connector;

wherein the connector body surrounds the plurality of electrical contacts; and wherein at least one of the plurality of electrical contacts is configured to establish an electrical ground path through the multi-contact portion, the electrical ground path electrically coupling each of the first prepared coaxial cable and the second prepared coaxial cable.

9. The multi-conductor coaxial cable connector of claim 8, wherein the multi-conductor coaxial cable connector is at least one of a female-type connector and a male-type connector.

10. The multi-conductor coaxial cable connector of claim 8, wherein the first prepared coaxial cable includes an inner conductor which carries a first electrical path.

11. The multi-conductor coaxial cable connector of claim 8, wherein the second prepared coaxial cable includes an inner conductor which carries a second electrical path.

12. The multi-conductor coaxial cable connector of claim 8, wherein the fastener member is configured to compress at least a portion of the clamping element onto a portion of the first prepared coaxial cable and the second prepared coaxial cable.

13. The multi-conductor coaxial cable connector of claim 8, further comprising:

a first insulator partially disposed within a first opening of the connector body and configured to receive a second electrical contact; and a second insulator partially disposed within a second opening of the connector body and configured to receive a third electrical contact;

wherein the first and second insulators electrically isolate the second and third electrical contacts from the connector body.

14. A multi-conductor coaxial cable connector comprising:

a cable connection portion, wherein the cable connection portion comprises:

a first post configured to receive a portion of a first prepared coaxial cable;

a second post configured to receive a portion of a second prepared coaxial cable;

a clamping element configured to seize a portion of the first and second prepared coaxial cables; and a fastener member configured to compress at least a portion of the clamping element onto a portion of the first prepared coaxial cable and the second prepared coaxial cable;

a multi-contact portion coupled to the cable connection portion, the multi-contact portion having a plurality of contacts;

a connector body surrounding the first post and the second post; and a conductive member located within the connector body, the conductive member configured to receive a plurality of electrical contacts;

wherein at least one of the plurality of electrical contacts is configured to electrically communicate a ground path through the multi-contact portion, the ground path electrically coupling each of the first prepared coaxial cable and the second prepared coaxial cable.

15. The multi-conductor coaxial cable connector of claim 14, wherein the plurality of electrical contacts are at least partially positioned within the connector body.

16. The multi-conductor coaxial cable connector of claim 14, wherein the plurality of electrical contacts are non-concentrically aligned.

17. The multi-conductor coaxial cable connector of claim 14, further comprising:

a first insulator partially disposed within a second opening of the conductive member and configured to receive a second electrical contact; and a second insulator partially disposed within a third opening of the conductive member and configured to receive a third electrical contact;

wherein the first and second insulators electrically isolate the second and third electrical contacts from the conductive member.

18. The multi-conductor coaxial cable connector of claim 17, wherein a first socket is disposed within the second electrical contact and a second socket is disposed within the third electrical contact, and the first socket and the second socket are configured to facilitate physical and electrical contact through the multi-conductor coaxial cable connector.

19. The multi-conductor coaxial cable connector of claim 14, wherein the clamping element comprises a grommet.

20. A multi-conductor cable connector comprising:

a cable connection portion configured to at least partially receive a plurality of prepared coaxial cable portions, the cable connection portion including:

a clamping element configured to be clamped to a portion of a cable jacket of each of the prepared coaxial cable portions; and a fastener member having an inner surface configured to surround and compress a portion of the clamping element onto a portion of each of the cable jackets; and a multi-conductor portion configured to be coupled to the cable connection portion so as to electrically couple the prepared coaxial cable portions to one another.

21. The multi-conductor cable connector of claim 20, wherein the multi-conductor portion includes a plurality of contacts.

22. The multi-conductor cable connector of claim 21, wherein each contact of the plurality of contacts extends along a different axis.

23. The multi-conductor cable connector of claim 21, wherein at least one of the plurality of contacts is configured to electrically couple a first prepared coaxial cable and a second prepared coaxial cable to one another.

24. The multi-conductor cable connector of claim 20, wherein the multi-conductor portion includes a connector body electrically and mechanically coupled with a post, the connector body including a plurality of openings.

25. The multi-conductor cable connector of claim 20, wherein the cable connection portion further includes:

a first post configured to receive a first prepared coaxial cable; and a second post configured to receive a second prepared coaxial cable.

26. The multi-conductor cable connector of claim 20, wherein the multi-conductor portion includes a conductive member at least partially disposed within a connector body, the conductive member further including a plurality of openings.

* * * * *